US012030709B2

(12) United States Patent
Fidler

(10) Patent No.: US 12,030,709 B2
(45) Date of Patent: Jul. 9, 2024

(54) NESTED FLUID DISPENSING SYSTEM

(71) Applicant: Bottleshotz LLC, Pepeekeo, HI (US)

(72) Inventor: Robert L. Fidler, Hilo, HI (US)

( * ) Notice: Subject to any disclaimer, the term of this patent is extended or adjusted under 35 U.S.C. 154(b) by 0 days.

(21) Appl. No.: 18/460,045

(22) Filed: Sep. 1, 2023

(65) Prior Publication Data

US 2024/0124210 A1 Apr. 18, 2024

Related U.S. Application Data

(60) Provisional application No. 63/417,001, filed on Oct. 18, 2022.

(51) Int. Cl.
*B65D 81/32* (2006.01)
*B65D 41/04* (2006.01)
*B65D 51/16* (2006.01)

(52) U.S. Cl.
CPC ..... *B65D 81/3227* (2013.01); *B65D 41/045* (2013.01); *B65D 51/1683* (2013.01); *B65D 2205/02* (2013.01)

(58) Field of Classification Search
CPC ..... B65D 81/3227; B65D 41/045; B65D 51/1683; B65D 2205/02
See application file for complete search history.

(56) References Cited

U.S. PATENT DOCUMENTS 3,779,372 A 12/1973 de Lloret
4,221,291 A 9/1980 Hunt
4,585,150 A * 4/1986 Beacham ..... C04B 41/009 222/481.5
5,215,214 A 6/1993 Lev et al.
5,217,433 A 6/1993 Bunin
6,363,978 B2 4/2002 Castillo
6,971,551 B2 * 12/2005 Widgery ..... A47G 19/2266 222/145.5
8,875,926 B2 11/2014 Grajqevci
10,758,924 B2 * 9/2020 Kang ..... B65D 81/32
11,440,724 B2 9/2022 Fidler
2007/0045342 A1 * 3/2007 Pigliacampo ..... A45F 3/20 222/129
2007/0241114 A1 10/2007 Roberts
(Continued)

FOREIGN PATENT DOCUMENTS

JP 2014125277 A 7/2014

*Primary Examiner* — Vishal Pancholi
(74) *Attorney, Agent, or Firm* — Richard Eldredge; Eldredge Law Firm

(57) ABSTRACT

A liquid dispensing container assembly comprises an internal container attachable to an outer container, and allows a user to selectively dispense multiple liquids from the container assembly. The internal container includes a head that is securable to an orifice of the outer container and defines a container opening that is fluidly coupled to an interior portion of the outer container, and includes a reservoir opening that is fluidly coupled to a reservoir defined by an elongate body of the inner container. The elongate body is coupled to the head and nested within the outer container while the head is coupled at the orifice. A liquid is dispensable from the reservoir via the reservoir opening, while another liquid is dispensable from the interior portion of the container via the container opening. The first and second liquids may be dispensed individually or simultaneously from the fluid dispensing system.

19 Claims, 19 Drawing Sheets

(56) References Cited

U.S. PATENT DOCUMENTS

| | | | | |
|---|---|---|---|---|
| 2009/0272747 | A1 | 11/2009 | Kalaouze, Jr. | |
| 2010/0224511 | A1 | 9/2010 | Boatner | |
| 2013/0334250 | A1* | 12/2013 | Albaum | B65D 81/3272 222/129 |
| 2017/0349330 | A1 | 12/2017 | Roberts | |
| 2018/0327142 | A1 | 11/2018 | Nikolic | |
| 2019/0322425 | A1 | 10/2019 | Beery | |

* cited by examiner

NESTED FLUID DISPENSING SYSTEM

CROSS REFERENCE TO RELATED APPLICATION

The present application claims priority of U.S. provisional application Ser. No. 63/417,001, filed on Oct. 18, 2022, which is hereby incorporated herein by reference in its entirety.

BACKGROUND AND FIELD OF THE INVENTION

The present invention is directed to a system for storing and dispensing fluids, and particularly to a system comprising an internal reservoir or container that may be nested in a bottle for storing and selectively dispensing multiple liquids from the bottle.

It is common for a container to store or contain a beverage, for example, a glass bottle that contains a human consumable liquid. A bottle cap affixed to the bottle may be removed to allow the beverage within the bottle to be accessed, for example, so that a user may drink the beverage from the bottle. The user may also mix the beverage with a second beverage, such as one that is contained in another bottle. In an effort to provide convenience to consumers, producers of beverage products may premix two or more liquids into a single container. This avoids having to purchase two separate products in two containers and having to mix them at or prior to the time of consumption of the beverages.

SUMMARY OF THE INVENTION

The present invention provides a liquid storage and dispensing container or system comprising a bottle and an internal container or reservoir that may be manufactured as part of or as an attachment to the bottle, where the bottle is capped or sealed with a bottle cap. After removing the bottle cap, a user may access liquids from the bottle and/or internal container, including to individually or simultaneously dispense two or more liquids located and/or nested within the bottle. One liquid may be located within the internal portion of the bottle itself, while the other liquid may be located within the internal reservoir that is nested within the internal portion of the bottle. The reservoir is defined by a stem that is attached to a head, in which the head is secured to the bottle at an opening of the bottle. The head defines a reservoir opening through which the liquid within the reservoir may be dispensed, and a container opening through which the liquid within the internal portion of the bottle may be dispensed. The head may also define one or more vent openings to facilitate a smoother and uninterrupted dispensing of the liquids. The user may choose to dispense only one liquid at a time by tipping the bottle in a specific direction or by obstructing one or more openings through which one of the liquids is dispensed, or the user may also choose to dispense both liquids simultaneously.

According to one form of the present invention, a liquid storage and dispensing assembly includes an outer container having an orifice and defining an internal volume configured to hold a first liquid. An internal container is disposable within the internal volume, and includes a reservoir body defining a reservoir for holding a second liquid separate from the first liquid. A head is coupled at the orifice and has a container opening and a reservoir opening. The container opening is in fluid communication with the internal volume to enable the first liquid to be dispensed from the container opening, and the reservoir opening is in fluid communication with the reservoir to enable the second liquid to be dispensed from the reservoir opening.

In one aspect, the first liquid is dispensable from the internal volume via the container opening while the second liquid is not dispensed from the reservoir. The second liquid is dispensable from the reservoir via the reservoir opening while the first liquid is not dispensed from the internal volume. The first and second liquids are also simultaneously dispensable from the reservoir and the internal volume via the container opening and the reservoir opening, respectively.

In another aspect, the head includes a first half and a second half that are delineated by a center axis. The container opening is defined within the first half, and the reservoir opening is defined within the second half.

In yet another aspect, the head includes a vent opening fluidly coupled to the reservoir.

In still another aspect, the reservoir body includes a lower portion and an upper funnel portion. The funnel portion has a smaller cross-sectional area than the lower portion and includes an upper end at which the reservoir opening is disposed. The head includes a reservoir passageway through which the funnel portion is inserted, where the upper end of the funnel portion exposed at an upper surface of the head.

In a further aspect, a cap is coupled at the orifice, in which the cap is selectively removable from the orifice and encloses the internal container within the outer container when the cap is coupled at the orifice. Optionally, a seal is coupled to the head and covers the reservoir opening, in which the seal removable from the head upon the cap being removed from the orifice. The seal may further include a non-peelable adhesive disposed on a cap-facing side of the seal, and a peelable adhesive disposed on a head-facing side of the seal such that the seal remains coupled to the cap when the cap is removed from the orifice. The seal may have an annular shape that is foldable into a C-shaped seal that covers the reservoir opening. Optionally, the cap is rotatable in an opening direction to be removed from the orifice, in which inwardly facing sides of the C-shaped seal slide relative to one another when the cap is rotated in the opening direction to be removed from the orifice.

In yet a further aspect, the head includes a circular outer perimeter surface that mates with an inner diameter of the orifice. Optionally, the container opening defines a closed loop passageway.

According to another form of the present invention, an internal container assembly for retaining a liquid and nesting within an outer container retaining another liquid includes a reservoir body defining a reservoir, and a head coupled to the reservoir body that includes a container opening and a reservoir opening. The head may be coupled at an orifice of the outer container, such that when the head is coupled at the orifice, the internal container assembly is nested within the outer container, the container opening is fluidly coupled to an internal volume of the outer container to enable a first liquid contained within the internal volume to be dispensed from the container opening, and the reservoir opening is fluidly coupled to the reservoir to enable a second liquid contained within the reservoir to be dispensed from the reservoir opening.

In one aspect, a removable seal is coupled to the head and covers the reservoir opening.

In another aspect, the head includes a vent opening that is fluidly coupled to the reservoir.

In yet another aspect, the head has a circular outer perimeter surface that mates with an inner diameter of the orifice of the outer container.

In still another aspect, the reservoir body includes an elongate cylindrical body and an end cap removably coupled to a lower portion of the reservoir body. Optionally, the reservoir body has an upper funnel portion having a smaller cross-sectional area than the lower portion. The funnel portion includes an upper end at which the reservoir opening is disposed. The head further includes a reservoir passageway through which the funnel portion is inserted with the upper end of the funnel portion exposed at an upper surface of the head.

According to yet another form of the present invention, a liquid storage and dispensing assembly includes an outer container having an orifice and defining an internal volume for holding a first liquid. An internal container assembly is nested within the internal volume, and includes a reservoir body defining a reservoir for holding a second liquid separate from the first liquid. A head is mated at an inner diameter of the orifice to form a fluid-tight connection between the head and the inner diameter of the orifice, and includes a first half and a second half delineated by a center axis. A container opening is disposed at the first half and defines a closed loop passageway fluidly coupled to the internal volume. A reservoir opening is disposed at the second half and is fluidly coupled to the reservoir. The first and second liquids remain separate from one another until the outer container is oriented to selectively: (i) dispense the first liquid from the container opening independent of the second liquid being dispensed from the reservoir opening; (ii) dispense the second liquid from the reservoir opening independent of the first liquid being dispensed from the container opening; or (iii) dispense both the first and second liquids simultaneously from the container opening and the reservoir opening, respectively. Optionally, the reservoir body includes a lower portion, an upper funnel portion, and a curved section connecting the lower portion to the funnel portion. The funnel portion has a smaller cross-sectional area than the lower portion and includes an upper end at which the reservoir opening is disposed.

Thus, the fluid dispensing system of the present invention enables a user to selectively dispense a first liquid from a container and a second liquid from a reservoir that is nested within the container. For example, the user may: have a first drink from the container that only includes the first liquid; have a second drink from the container that only includes the second liquid; and have a third drink from the container that includes the first liquid and the second liquid, and in which the first liquid and the second liquid are not mixed until the liquids exit an orifice of the container and/or the fluid dispensing system. Accordingly, the fluid dispensing system allows the user the ability to customize their beverage drinking experience as desired. Specifically, a fluid dispensing system enables a plurality of desirable drink combinations—such as sweet tea and lemonade, or rum and cola—to be conveniently and separately stored within a single beverage container in a way that allows a user to consumer each component of the drink as desired.

These and other objects, advantages, purposes and features of this invention will become apparent upon review of the following specification in conjunction with the drawings.

DESCRIPTION OF THE PREFERRED EMBODIMENTS

Figure 1:
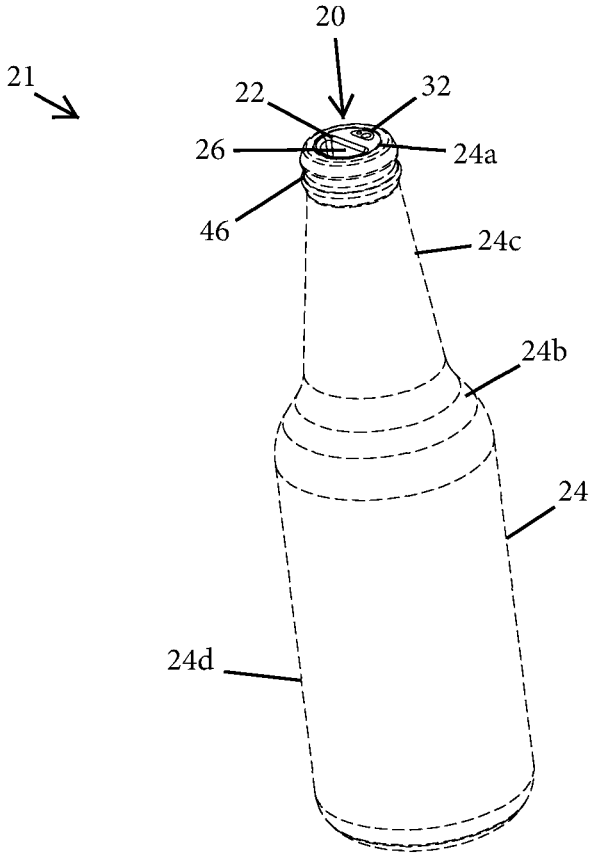
FIG. 1 is a perspective view of a liquid storage and dispensing system in accordance with the present invention comprising a bottle fitted with an internal reservoir.

The present invention will now be described with reference to the accompanying figures, wherein the numbered elements in the following written description correspond to like-numbered elements in the figures. As shown in the illustrated embodiment of FIGS. 1-7, a liquid storage and dispensing container assembly 21 includes an internal container or reservoir assembly 20 having a reservoir body 23 and a head 22 that is securable to a neck or upper portion 24*a* of an outer container comprising a bottle 24. Bottle 24 comprises a first container for holding and dispensing a first liquid and the internal container 20 comprises a second container for holding and dispensing a second liquid. Head 22 defines or includes a through hole or opening 26 comprising a passageway through which liquid within bottle 24 may be dispensed, such as when bottle 24 is tilted. Internal container 20 additionally includes a reservoir passageway or opening 32 through which liquid within internal container 20 may be dispensed, such as when bottle 24 is tilted. Accordingly, a consumer may simultaneously dispense two separate liquids, such as by removing a bottle cap 42 (FIG. 5) from bottle 24 to enable both liquids to be poured from the container assembly 21, where cap 42 may be secured to upper portion 24*a* of bottle 24 to cover head 22 and seal or enclose internal container 20 within bottle 24. Thus, the consumer can drink multiple liquids as desired from an orifice of bottle 24, in which the liquids are enclosed within bottle 24 (with at least one liquid being further enclosed within nested container 20) via cap 42 and an optional seal as described in further detail below.

With reference to the illustrated embodiment, internal container assembly 20 includes elongate reservoir body 23 defining a reservoir 37 attached to head 22 and within which the second liquid is contained. Reservoir body 23 includes a hollow lower cylindrical portion 25 and an upper funnel portion 30. As best understood from FIG. 5, head 22 includes a funnel passageway or through hole 28 configured to receive and secure the end 27 of funnel portion 30 when inserted into passageway 28, where in the illustrated embodiment funnel portion 30 has a semicircular cross section with passageway 28 having a corresponding shape. Funnel portion 30 may be secured to head 22, such as by a press fit connection or the like. As understood from FIGS. 5 and 7, funnel portion 30 includes the noted reservoir passageway or opening 32 and a vent passageway or opening 34 that both open on end face 35 of end 27 and are fluidly connected to the elongated reservoir 37 defined by lower portion 25 of reservoir body 23. Lower portion 25 has a lower end 36 that receives an end cap 38 to fluidly seal reservoir 37 from the interior volume or container portion 40 of bottle 24.

As shown, internal container 20 is nested within the interior volume 40 of bottle 24 and is sealed by cap 42. Head 22 has a circular outer side surface 22*a* that is securable to an internal surface of the neck or throat of bottle 24 that defines a container orifice or bottle orifice 44. Side surface 22*a* of head 22 thus fits complimentary to and/or fully mates with an inner diameter of bottle orifice 44 to form a fluid-tight and/or sealed connection between head 22 and bottle 24. Although head 22 may be secured to bottle 24 via frictional engagement or a press-fit connection, an adhesive and/or one or more gaskets may also be used to further secure head 22 to bottle 24. As shown in the illustrated embodiment of FIG. 4, when head 22 is secured to bottle 24, a top surface 22*b* of head 22 is approximately level and/or flush with an upper outer orifice surface 44*a* of bottle 24, and a bottom surface 22*c* of head 22 is located within container portion 40. Although in the illustrated embodiment head 22 is shown as including a circular outer surface 22*a* with opening 26 forming a closed loop passageway through head 22, it should be appreciated that alternative configurations may be employed. For example, a head need not include a fully circular outer surface, but instead may include a radially open portion that allows fluid from within the internal volume 40 of bottle 24 to be dispensed past such a head, whereby the container opening would not form a closed loop passageway, but instead a portion of the passageway for dispensing liquid from the interior volume of the bottle would be defined by the internal wall of the bottle at the neck or throat of the bottle.

Figure 7:
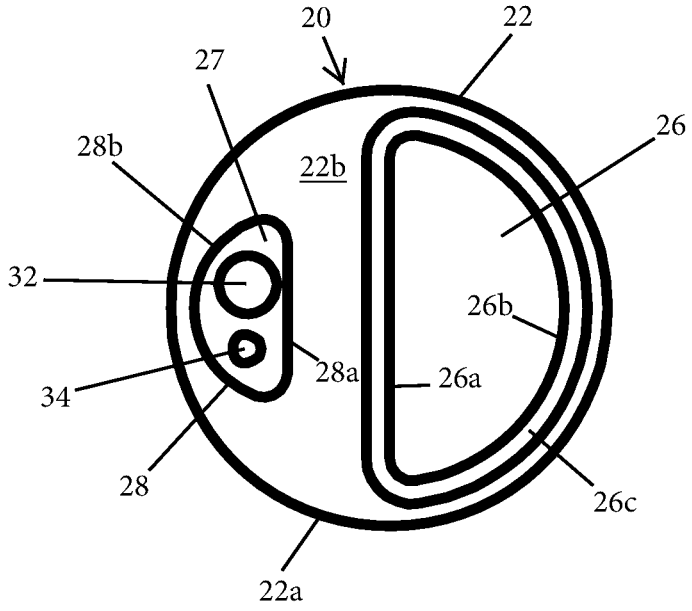
FIG. 7 is an enlarged view of the head of the internal container of FIG. 6.
Figure 8:
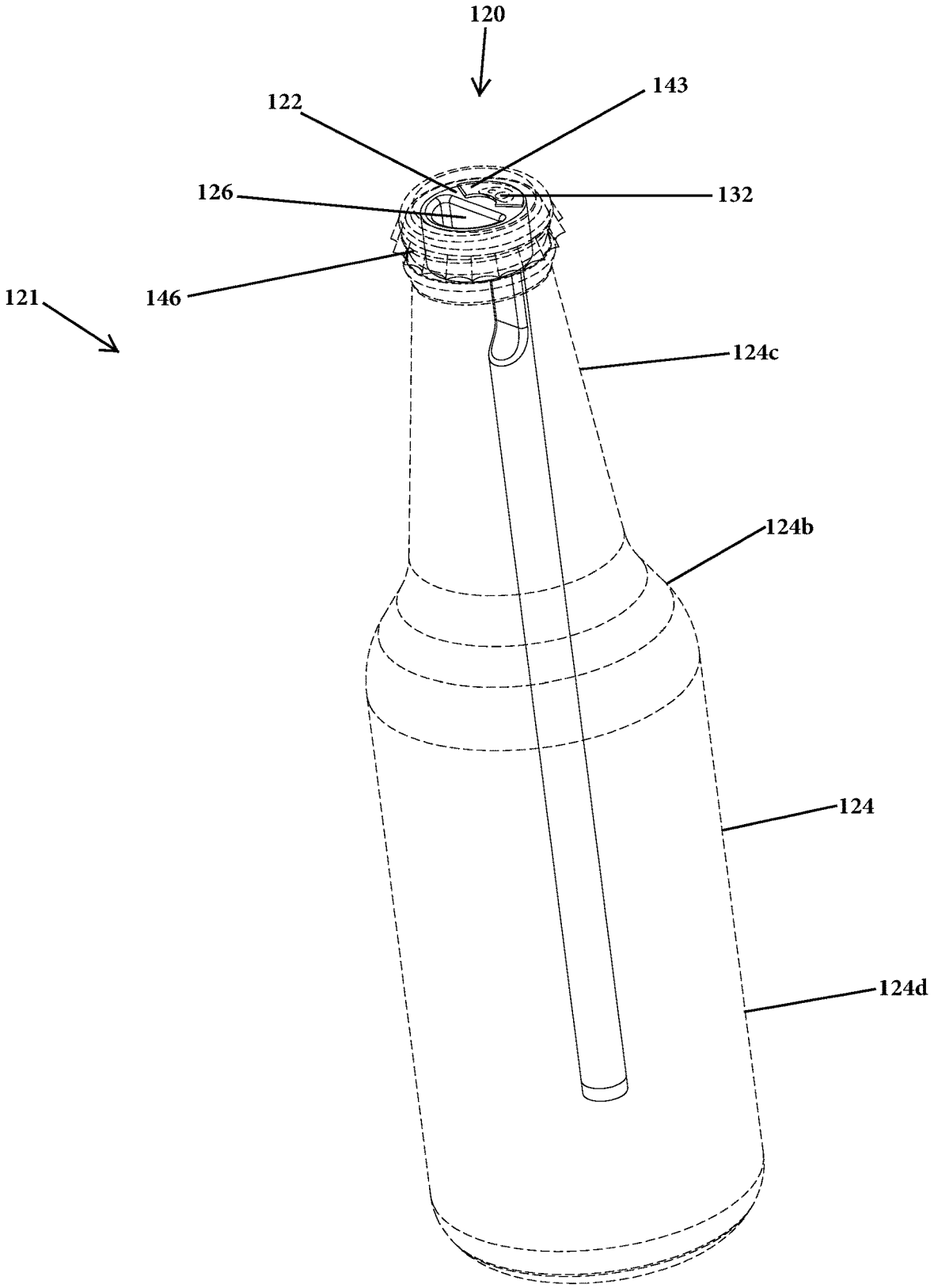
FIG. 8 is a perspective view of another liquid storage and dispensing system in accordance with the present invention in which the liquid storage and dispensing system includes a seal for use with a twist-off cap, and is shown secured to a glass bottle.
Figure 9:
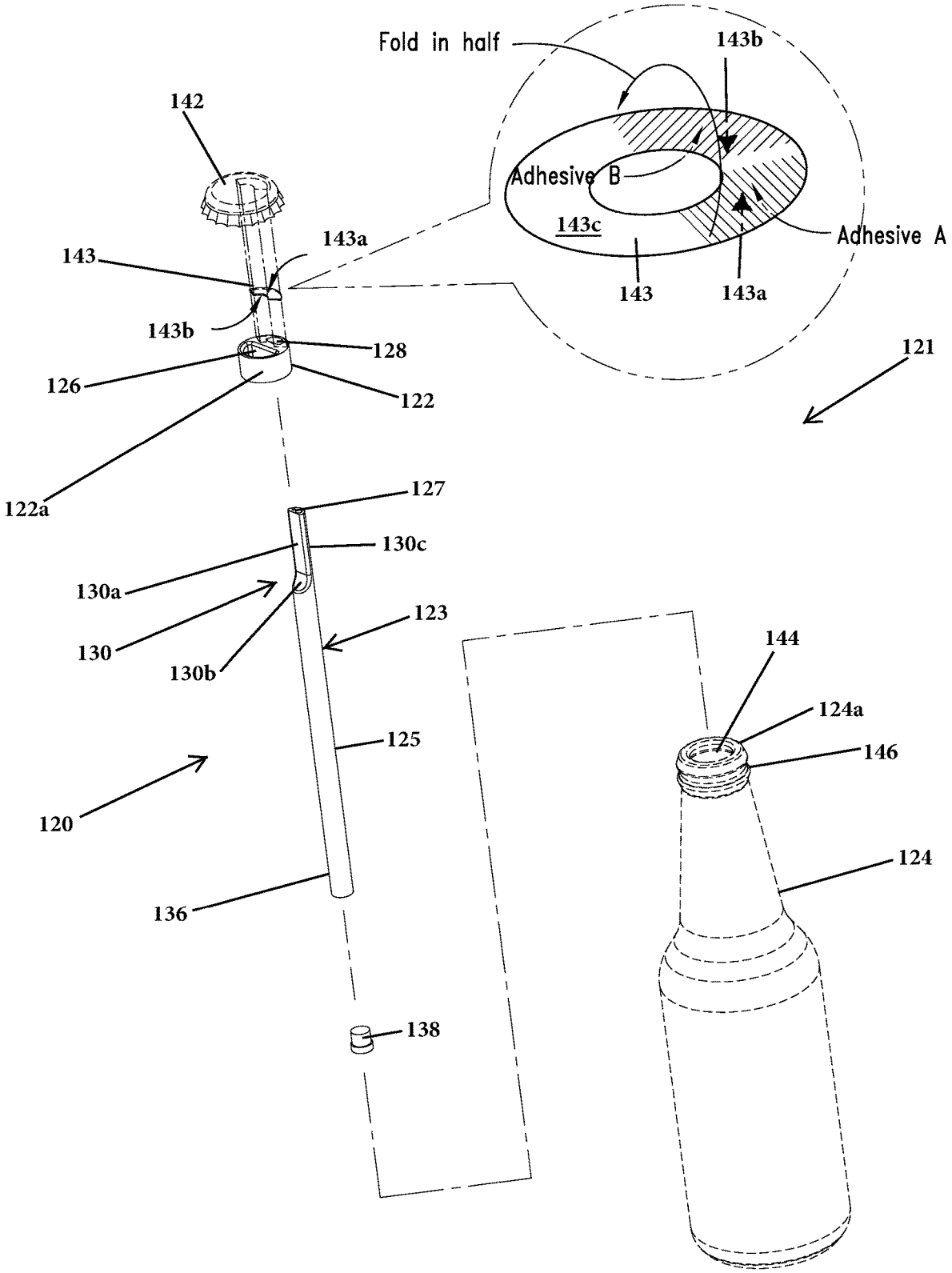
FIG. 9 is an exploded view of the liquid storage and dispensing system of FIG. 8, in which the seal is also shown in an unfolded position in an enlarged view.
Figure 10:
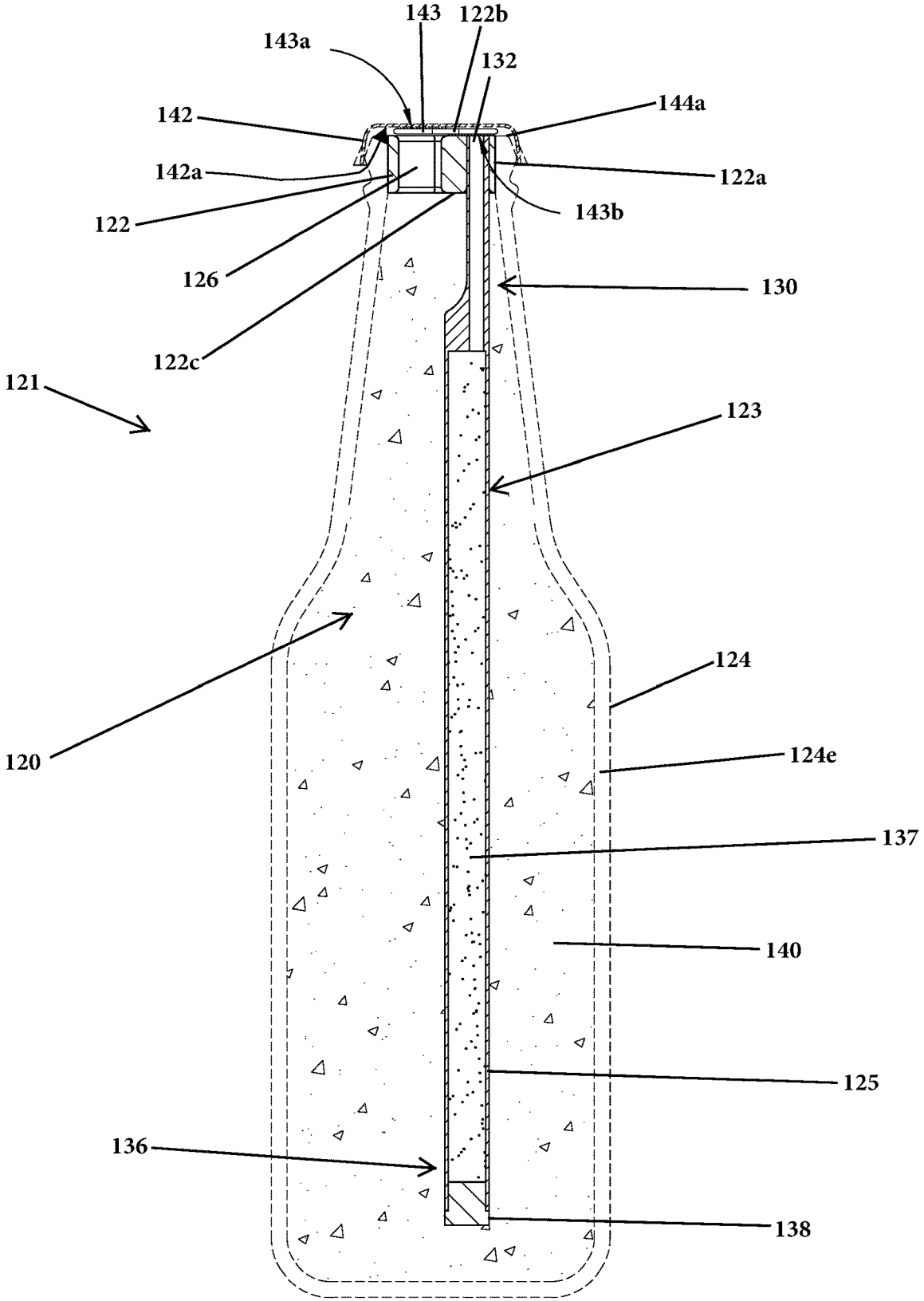
FIG. 10 is a side cross-sectional view taken along the middle of the liquid storage and dispensing system of FIG. 8.
Figure 11:
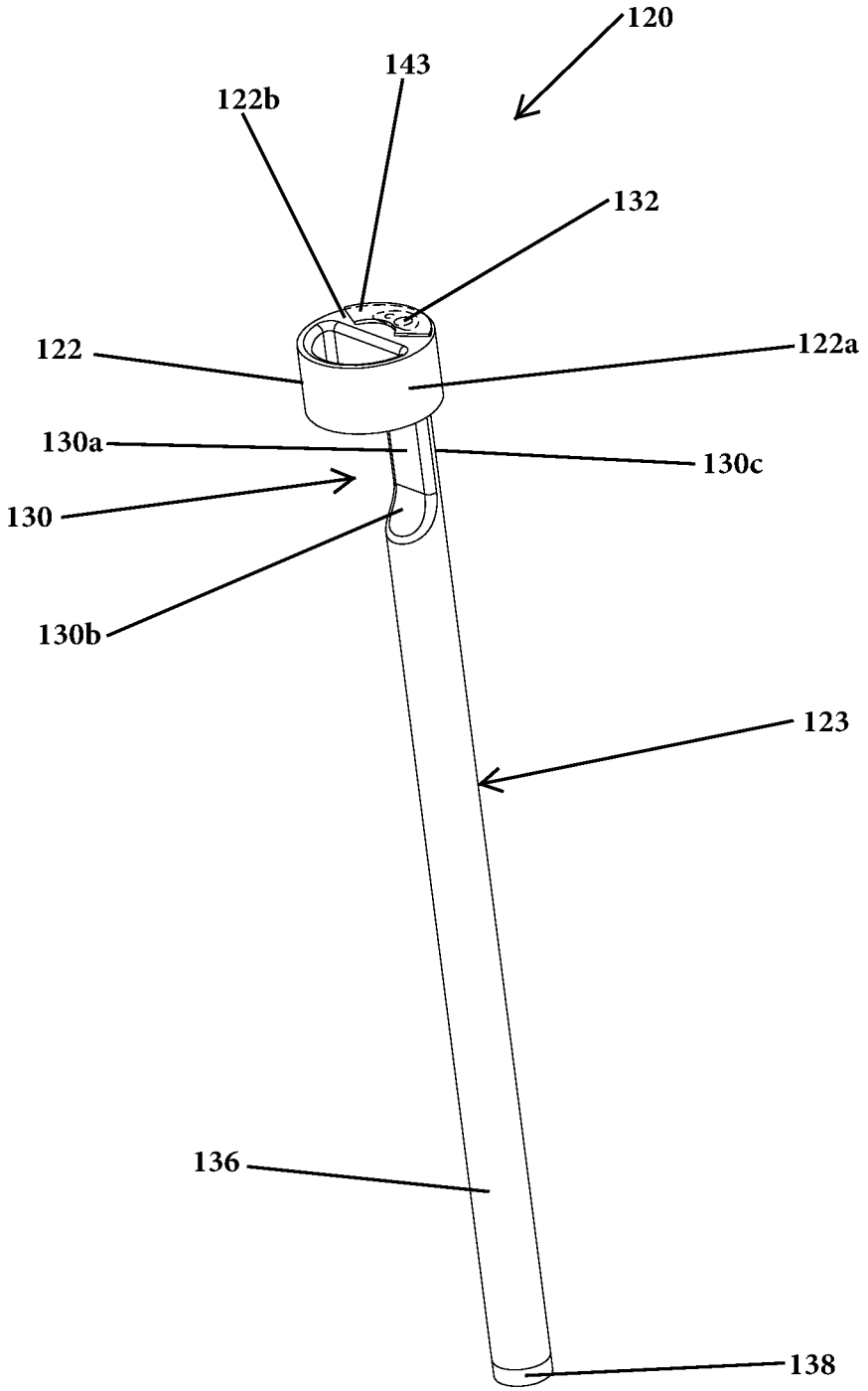
FIG. 11 is a perspective view of an internal container of the liquid storage and dispensing system of FIG. 8.

As best shown in FIG. 7, container opening 26 has a semi-circular or half circle geometry such that it has a straight portion 26*a* and a curved portion 26*b* defining the closed loop passageway, and extends through head 22 to fluidly connect to container portion 40, and includes a chamfer 26*c* about its perimeter openings. As noted, funnel opening 28 has a smaller cross-sectional area than container portion 26, and also includes a straight portion 28*a* and a curved portion 28*b*. Container opening 26 and funnel opening 28 are radially opposed from one another on head 22 in the illustrated embodiment. As understood from FIG. 3, container opening 26 is defined within a first half 29 of head 22, and funnel opening 28 is defined within a second half 31 of head 22, in which first half 29 and second half 31 are delineated and/or separated by a center axis 45 that runs through the geometric center of head 22 and first half 29 is on the right in FIG. 3 and second half 31 on the left. Additionally, container opening 26 and funnel opening 28 are both defined symmetrically about a transverse axis of head 22, in which the transverse axis also runs through the geometric center of head 22 and is oriented parallel to the center axis. The above arrangement of container opening 26 and funnel opening 28 is such that straight portions 26*a* and 28*a* are oriented parallel to one another. It should be appreciated that the shape, size, geometry, and arrangement of various openings defined by a head may vary within the scope of the present invention.

As noted, an upper end 27 of funnel portion 30 fits complimentary into funnel opening 28 to form a fluid-tight connection between funnel portion 30 and head 22, such as via frictional engagement and/or a press-fit connection, and may further include an adhesive and/or one or more gaskets for further sealing capabilities. A vertically straight and/or linear upper section 30*a* of funnel 30 is connected to a flared, curving, or non-linear transition section 30*b* that flares or curves laterally to expand or increase the cross-sectional area of funnel 30 relative to upper section 30*a* of funnel 30. Transition section 30*b* in turn is connected to lower cylindrical portion 25. Lower cylindrical body 25 and upper funnel portion 30 of the reservoir body 23 may be unitarily formed or separately formed and connected together.

The geometry of funnel portion 30 is such that funnel portion 30 maintains a laterally outboard side 30*c* having an identical curvature to curved portion 28*b* of funnel opening 28 on head 22. Both vent opening 34 and reservoir opening 32 comprise circular cross sectioned passageways through funnel portion 30, with vent opening 34 having a smaller diameter than reservoir opening 32. Both vent opening 34 and reservoir opening 32 extend through funnel portion 30 to fluidly connect to reservoir 37. It should be appreciated that a funnel may be integrally formed with a head and/or a stem within the scope of the present invention, or may be formed as a separate component that is later affixed to a head and/or a reservoir portion of a stem. Accordingly, a head—rather than a funnel portion—may define reservoir and/or vent openings that extend through a stem to fluidly connect with a reservoir defined by the stem. Additionally, a stem may have a funnel portion with varying geometry, or may include only a reservoir portion that is coupled directly to a head.

End 36 of lower portion 25 is configured to receive and secure end cap 38, such as via frictional engagement, press-fit connection, threaded engagement, or other form of engagement that provides a fluid-tight connection to prevent the exchange of fluids between reservoir 37 and container portion 40. Alternatively, an end cap may be integrally formed with a stem to form a fluid-impermeable barrier around a lower end and/or an outer wall of the stem. It should be understood that a stem and/or a reservoir portion may have varying geometry within the scope of the present invention. For example, a stem may be shaped to have a larger or smaller internal reservoir, or may define or include multiple reservoirs.

Figure 5:
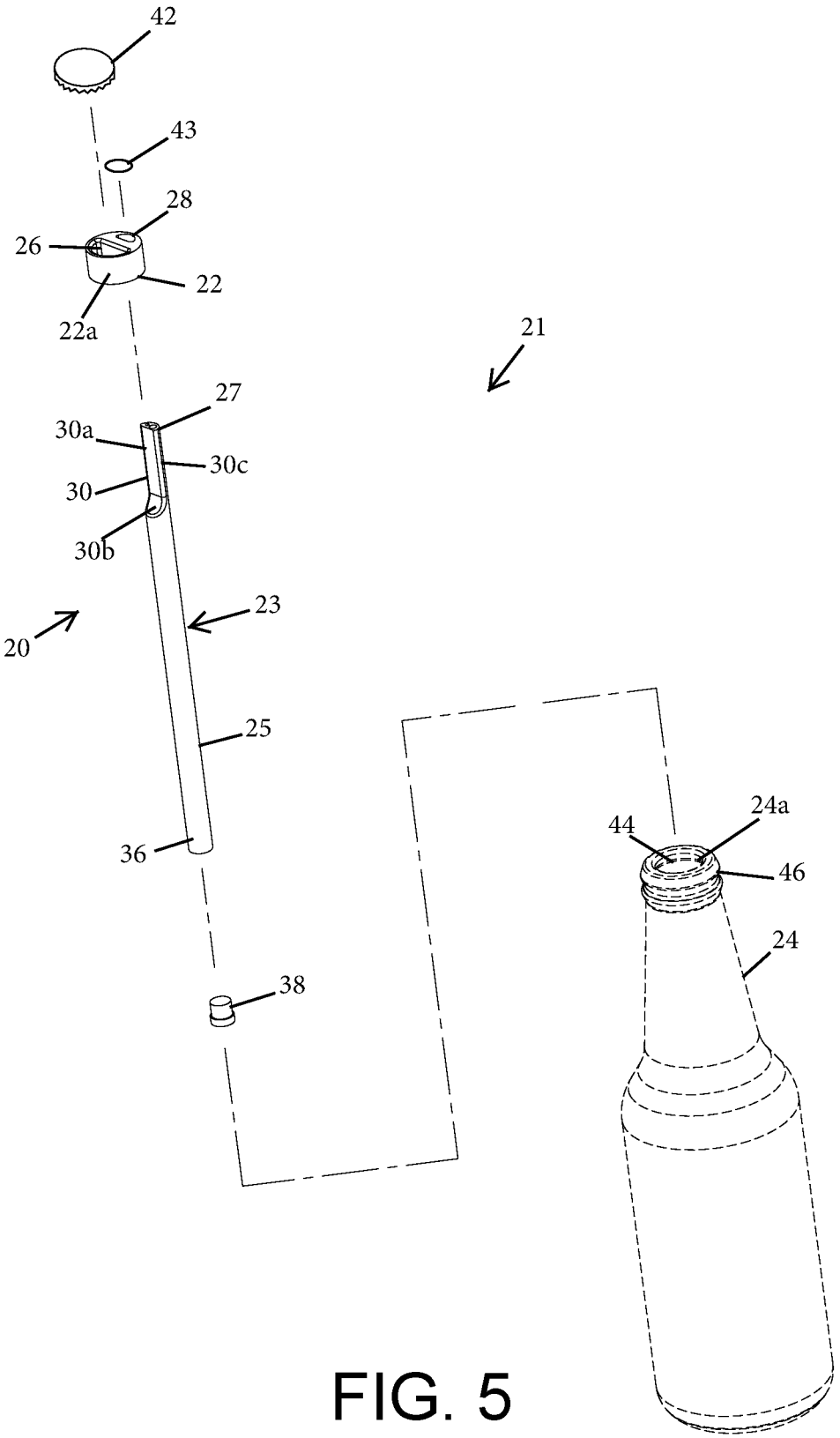
FIG. 5 is an exploded view of the liquid storage and dispensing system of FIG. 1.

Referring to FIG. 5, a seal or disk 43, which may be made of a polyester, plastic, and/or metallic foil film having food-grade adhesive on opposing surfaces, is provided to cover funnel opening 28, reservoir opening 32, and vent opening 34. A lower surface of disk 43 may be adhered to head 22, such as for example before bottle cap 42 is secured to bottle 24. Securing bottle cap 42 to bottle 24 causes bottle cap 42 to come into contact with an upper surface of disk 43, where the upper surface of disk 43 may additionally include an adhesive to thereby further adhere disk 43 to bottle cap 42. Upon the removal of bottle cap 42, such as when a user removes bottle cap 42 before taking a drink, disk 43 may remain adhered to bottle cap 42, and therefore be removed or peeled away from head 22 when bottle cap 42 is removed. Disk 43 ensures the contents of reservoir 37 remain separated from the contents of container portion 40, and may help to preserve contents located within reservoir 37. It should be appreciated that a seal may also cover container opening 26, or that a fluid dispensing system may not include a seal at all. Still further, such a seal may be configured to be removed by a person, such as by being peeled off by a person, after cap 42 has been removed. Additionally, a seal may include a tag or ear to allow the seal to be more easily gripped or manipulated, for example, during the manufacturing process when the seal is placed/adhered to a head.

Figure 2:
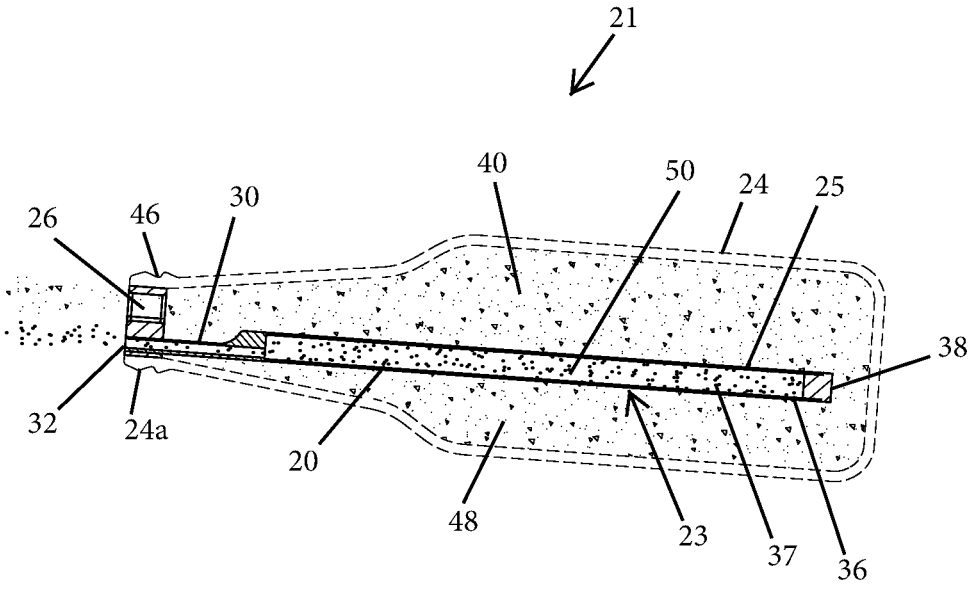
FIG. 2 is a cross-sectional view taken along the center of the bottle of FIG. 1, showing the liquid storage and dispensing system simultaneously dispensing two liquids.
Figure 4:
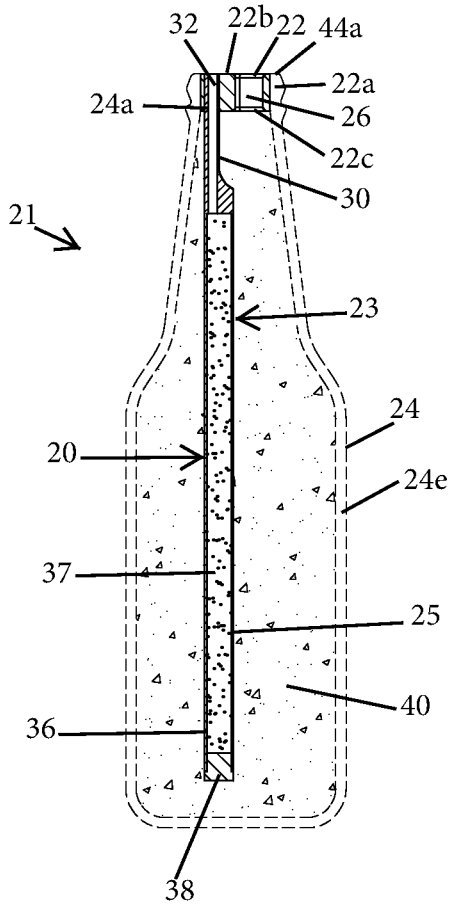
FIG. 4 is a side cross-sectional view of the liquid storage and dispensing system of FIG. 3 taken along the line IV-IV of FIG. 3.

Liquid storage and dispensing container assembly 21 allows the user to selectively dispense one or more distinct components, mixtures, or fluids either individually or collectively and/or simultaneously from a container such as bottle 24. With reference to FIGS. 2 and 4, container portion 40 may contain a first beverage 48, and reservoir 37 may contain a second beverage 50. If the user wishes to dispense both beverages 48, 50 together in a simultaneous fashion, the user may simply tip bottle 24 to a sufficient extent to cause first beverage 48 to flow from container portion 40 through container opening 26, and second beverage 50 to flow from reservoir 37 through reservoir opening 32. In this case, first and second beverages 48, 50 remain separated and/or do not mix until they have fully exited and/or been dispensed from fluid dispensing system 20. Due to the position of head 22 in the illustrated embodiment, beverages 48, 50 are also not mixed until they have exited the entire internal volume of bottle 24, or moved outward past orifice surface 44*a*. Additionally, locating container opening 26 at first half 29, and reservoir opening 32 at second half 31 such that openings 26 and 32 are substantially opposite one another at head 22, allows/facilitates the dispensing of multiple beverages as desired by the user from liquid storage and dispensing container assembly 21.

The user may also dispense first beverage 48 without dispensing second beverage 50, and vice versa. For example, the user may rotate and/or tip bottle 24 until container opening 26 is located at a vertically lower position than funnel opening 28, and preferably where straight portion 26*a* is located vertically higher than rounded portion 26*b*. The user may then tip bottle 24 until first beverage 48 is dispensed from container opening 26. Second beverage 50 will still remain within first reservoir 37, as reservoir opening 32 would be positioned vertically higher than the fluid level of second beverage 50 while bottle 24 is tipped by the user as described above. The user may similarly dispense second beverage 50 without dispensing first beverage 48 by rotating bottle 24 approximately 180 degrees, or such that funnel opening 28 is located vertically lower than container opening 26, in which straight portion 28*a* is preferably located vertically higher than curved portion 28*b*, and then tipping bottle 24 until second beverage 50 is dispensed from reservoir opening 32. Optionally, the user may also manually obstruct one or more openings to selectively dispense one beverage at a time, for example, by using their finger or tongue to cover the one or more openings. For example, the user may block reservoir opening 32 and vent opening 34 while tipping bottle 24 to individually dispense first beverage 48. Alternatively, the user may block container opening 26 while tipping bottle 24 to individually dispense second beverage 50.

Using liquid storage and dispensing container assembly 21 as described above allows the user the ability to customize the composition of each individual drink. For example, the user could have a first drink of lemonade that is dispensed from container opening 26. The user could then have a second drink of sweet tea that is dispensed from reservoir opening 32. The user may then have a third drink in which both lemonade and sweet tea are simultaneously dispensed from fluid dispensing system 20. The user could then rotate bottle 24 during a fourth drink to alter the ratio and/or amounts of lemonade and sweet tea that are dispensed from fluid dispensing system 20. To illustrate, the user could initially dispense only lemonade from container opening 26, then rotate bottle 24 while lemonade is still being dispensed from container opening 26 to add a controlled and/or desired amount of sweet tea into the beverage concoction being delivered to the consumer's mouth via reservoir opening 32.

Figure 3:
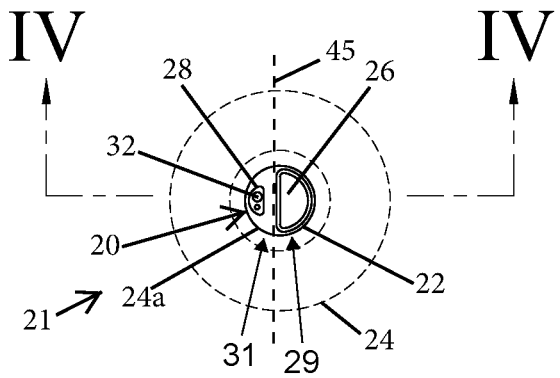
FIG. 3 is a top plan view of the liquid storage and dispensing system of FIG. 1.
Figure 6:
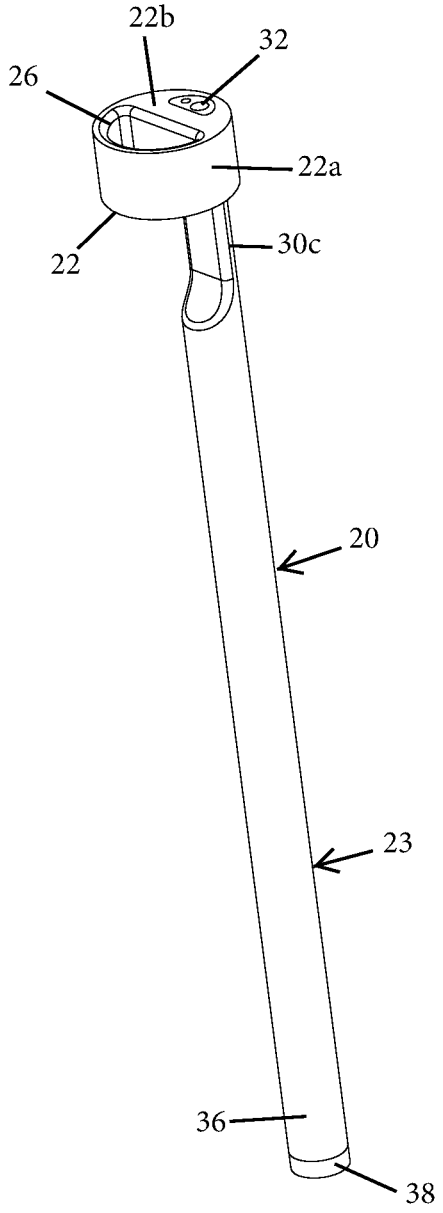
FIG. 6 is a perspective view of the internal container of the liquid storage and dispensing system of FIG. 1.

Referring to FIGS. 1, 3, and 6, as liquid is dispensed from the container assembly 21, air is drawn into reservoir 37 and/or container portion 40. The shape and size of container opening 26 is large enough to allow liquid to exit container opening 26 concurrent with air entering container opening 26. However, due to the relatively small size of reservoir opening 32, the smooth exchange of air into reservoir 37 while liquid flows out of reservoir 37 may be inhibited. Therefore, vent opening 34 is provided as a separate and dedicated air intake passageway into reservoir 37, thus facilitating a smooth and/or uninterrupted flow of liquid out of reservoir opening 32.

Uninterrupted and/or efficient fluid flow of liquid exiting or being dispensed from container portion 40 is also improved or facilitated via the curved and/or flared outer profile of funnel portion 30, previously described above. Specifically, as compared to a straight-angled or less gradual connection between funnel portion 30 and lower portion 25, such as a right angle connection, the funnel-like geometry of funnel portion 30 helps to or promotes siphoning of a liquid proximate funnel portion 30. That is, the curved geometry of funnel portion 30 promotes more orderly, efficient, smooth, and/or laminar flow of a liquid within container portion 40, and/or reduces the potential for turbulent liquid flow, such as while the liquid is being dispensed from container portion 40. Promoting less turbulent fluid flow characteristics in this way facilitates or improves the user's ability to more smoothly and/or efficiently dispense a liquid from container portion 40. It should be appreciated that both the interior and exterior portions of funnel portion 30 may be smooth or curved to promote the siphoning or smooth flow of liquids inside reservoir 37 (e.g. the second liquid) and outside reservoir 37 in container portion 40 (e.g. the first liquid).

Internal container 20 may be formed as a component of bottle 24 when bottle 24 is originally manufactured, or may be added later and/or retrofitted to bottle 24 after bottle 24 has been manufactured and/or filled with a liquid. Reservoir 37 may be initially filled with a liquid, for example, prior to installing end cap 38 onto lower end 36 of lower portion 25. End cap 38 may be selectively removed and re-secured from lower end 36 of lower portion 25 by a user to allow the user to re-fill reservoir 37 with a desired liquid and re-use reservoir 37 with another bottle or container. For example, once the user finishes drinking the liquid(s) from bottle 24 and/or reservoir 37, the user may selectively remove internal container assembly 20, which may require decoupling head 22 from orifice 44, remove end cap 38 from lower end 36, re-fill reservoir 37 with a liquid or multiple liquids according to user preference, and couple internal container assembly 20 to bottle 24 or a new bottle or container having another liquid. Thus, internal container assembly 20 may be a re-usable and re-fillable component for use with multiple containers over time and according to a user's preferences. It should be appreciated that an internal container may include multiple reservoirs in which each has its own reservoir and vent openings. In addition, alternative internal containers may be larger or smaller or different shapes, such as to include more or less liquid.

Bottle 24 in the illustrated embodiment comprises a glass bottle, such as for soda, beer or other carbonated or non-carbonated beverages, but may alternatively be configured as a plastic bottle or other such container. When bottle 24 is configured as a beer bottle with the first liquid being beer, the internal container 20 may contain liquor, such as whiskey or the like. It should be appreciated, however, that numerous different combinations of beverages may be combined using a liquid storage and dispensing container assembly of the present invention, including both alcoholic and non-alcoholic beverages. Still further, bottle 24 may take alternative forms having varying shapes and dimensions. In the illustrated embodiment, bottle 24 has a rounded shoulder 24*b* that transitions and connects a neck portion 24*c* to a cylindrical bottom or base 24*d*. Bottle 24 comprises an outer bottle wall 24*e* that defines container portion 40 and an exterior connector 46 that may comprise a flange or threads at upper portion 24*a*. Bottle wall 24*e* also defines circular bottle orifice 44 that has an internal cylindrical shape, where circular bottle cap 42, which may include a gasket or other sealing member, engages with connector 46 to form a fluid-tight barrier between container portion 40 and an external environment. It should be appreciated that connector 46 of bottle 24 could be in the form of multiple threads, or limited threads for a twist off cap, or may be in the form of a flange that requires a bottle opener for removal of the cap.

Accordingly, the liquid storage and dispensing assembly of the present invention includes an internal container assembly that is securable and nestable within an outer container, such as a bottle containing a first beverage, and allows a user to selectively dispense the first beverage and at least one additional and discrete second beverage simultaneously or independent of one another from or proximate the orifice of the outer container. A first fluid may be located within a container portion of the outer container, while a second liquid may be located within a reservoir defined by the internal container that is nested within the container portion of the outer container. The internal container may include a funnel that connects to a head, and that defines a reservoir opening where the second liquid is dispensable from the internal container. A vent opening provides a pathway for airflow into the reservoir as the second liquid is dispensed from the reservoir to facilitate smooth dispensing of the second liquid from the reservoir opening. The first liquid is dispensed from the container portion via a container opening defined by the head. The user may dispense and/or drink the first liquid independent of the second liquid and vice versa, and may also dispense and/or drink the first and second liquids together at the same time and at a desired ratio.

Referring now to the illustrated embodiment of FIGS. 8-13C, another liquid storage and dispensing container assembly 121 is shown that is similar to liquid storage and dispensing container assembly 21, with similar features of container assembly 121 relative to container assembly 21 being designated with like reference numbers, but with "100" added to each reference number of container assembly 121. Due to the similarities of container assembly 121 relative to container assembly 21, not all of the components and features of container assembly 121 are discussed herein. As shown, container assembly 121 has a reservoir assembly or internal container 120 disposed within a glass bottle 124, in which internal container 120 has a secondary liquid seal in the form of rotatable seal 143 that may be used to selectively seal a reservoir opening 132 and/or a vent opening 134 that are defined in an end 127 of a funnel portion 130. With specific reference to FIG. 9, while in an unfolded position rotatable seal 143 has a curved, non-linear, or circular shape having a center circular or curved cutout, which in the illustrated embodiment resembles a donut-shape. Alternatively, seal 143 may be considered to have or resemble an annular or ring shape. After being folded into a folded position, rotatable seal 143 resembles a C-shape or a curved or non-linear shape, in which an adhesive A is disposed on an upper or cap-facing side 143*a* of rotatable seal 143, and an adhesive B is disposed on a lower or head-facing side 143*b* of rotatable seal 143, and no adhesive is disposed on inwardly facing sides 143*c*. Adhesive A is a food-grade, non-peelable adhesive for one-time use, while adhesive B is a food-grade, peelable adhesive. It should be appreciated that an adhesive or other similar coupling element may vary from what has been described.

In the folded position, inwardly-facing sides 143*c* of rotatable seal 143—or the faces of rotatable seal 143 that are folded into contact with one another—have no adhesive, and thus remain in slidable contact with one another. As noted above, adhesives A and B are applied to a respective outer side of rotatable seal 143 (cap-facing side 143*a* and head-facing side 143*b*). Accordingly, rotatable seal 143 may be adhered between a cap, such as metal twist-off cap 142, and a head 122 of internal container 120 in various ways. For example, head-facing side 143*b* of rotatable seal 143 may be pressed into contact with head 122 such that rotatable seal 143 covers reservoir opening 132 and vent opening 134. Twist-off cap 142 may then be threaded, twisted, and/or rotated in a closing direction onto bottle 124, such that cap 142 engages with connective features 146 located at or near upper portion 124*a* of bottle 124 to become secured to bottle 124. A lower side 142*a* (FIG. 10) or face of cap 142 is moved in closer proximity to a top surface 122*b* of head 122 as cap 142 is threaded and/or twisted onto bottle 124. As a result, lower side 142*a* of cap 142 is brought into contact with cap-facing side 143*a* of rotatable seal 143. As cap 142 becomes fully engaged with and/or secured to bottle 124, lower side 142*a* of cap 142 is pressed more forcefully into cap-facing side 143*a* of seal 143, such that adhesive A properly adheres lower side 142*a* of cap 142 to cap-facing side 143*a* of rotatable seal 143. Alternatively, cap-facing side 143*a* may be placed into contact with lower side 142*a* of cap 142 prior to cap 142 being secured to bottle 124.

In either method of securing rotatable seal 143 between cap 142 and head 122, the inwardly facing sides of rotatable seal 143 are slidable relative to one another to permit movement between cap-facing side 143*a* and head-facing side 143*b*. For example, when lower side 142*a* of cap 142 is adhered to cap-facing side 143*a*, and head 122 and/or end 127 of funnel portion 130 are adhered to head-facing side 143*b*, the rotational motion of cap 142 while it is being secured to bottle 124 forces cap-facing side 143*a* to move relative to head-facing side 143*b*. It should be appreciated that alternative methods and/or additional steps of securing rotational seal 143 between cap 142 and head 122 and/or end 127 of funnel portion 130 could also be utilized. For example, a cap could be pressed and/or crimped onto a container, in which a lower side of the cap would come into contact with and become adhered to cap-facing side 143*a* of rotational seal 143, while head-facing side 143*b* would be or become adhered to a head and/or an end to a funnel portion.

Figure 12:
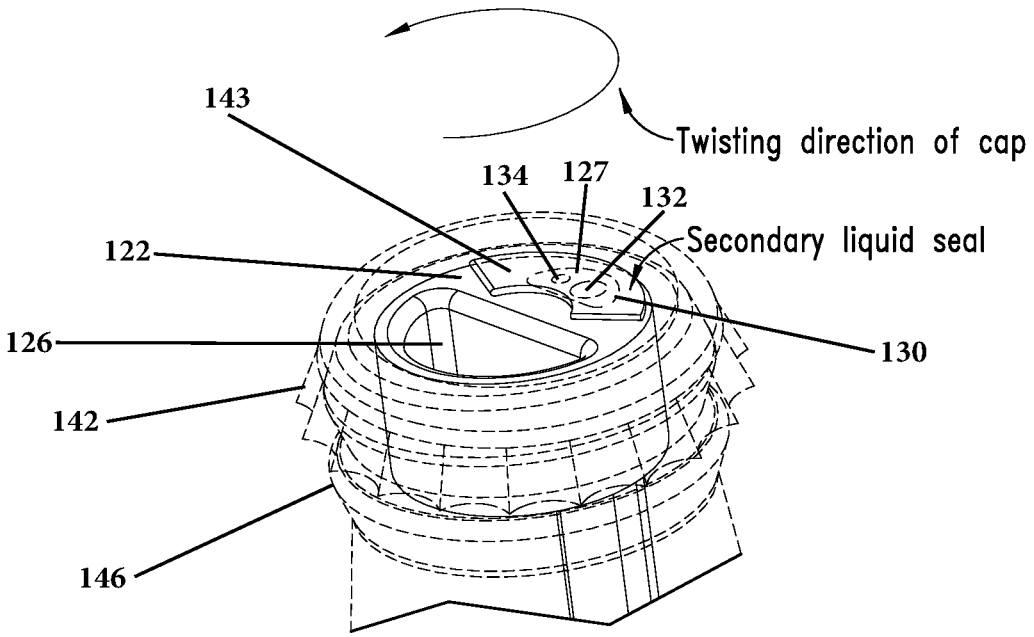
FIG. 12 is an enlarged view of a metal twist-off bottle cap of the glass bottle of FIG. 8.
Figure 13C:
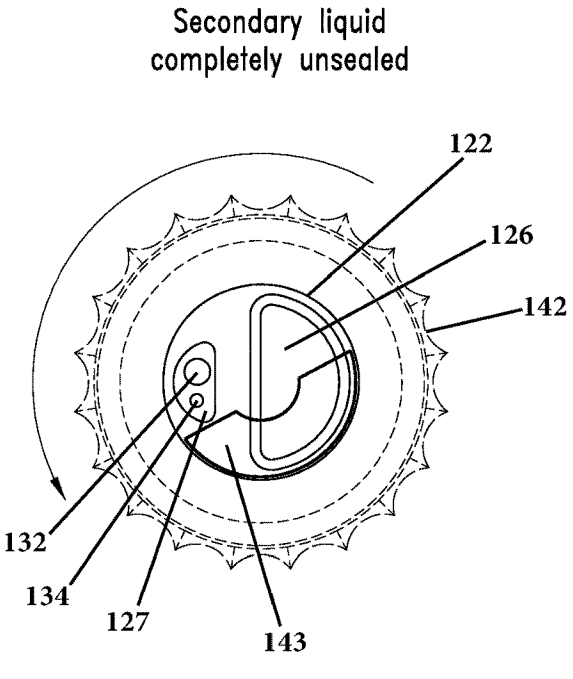
FIGS. 13A-C show different positions of the seal as the metal twist-off bottle cap of FIG. 12 is being rotated in an opening direction to unseal a reservoir portion of the liquid storage and dispensing system.
Figure 13B:
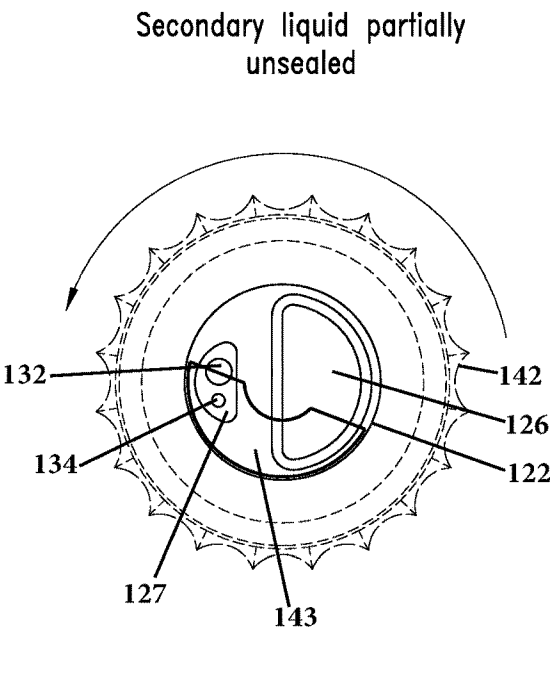
Figure 13A:
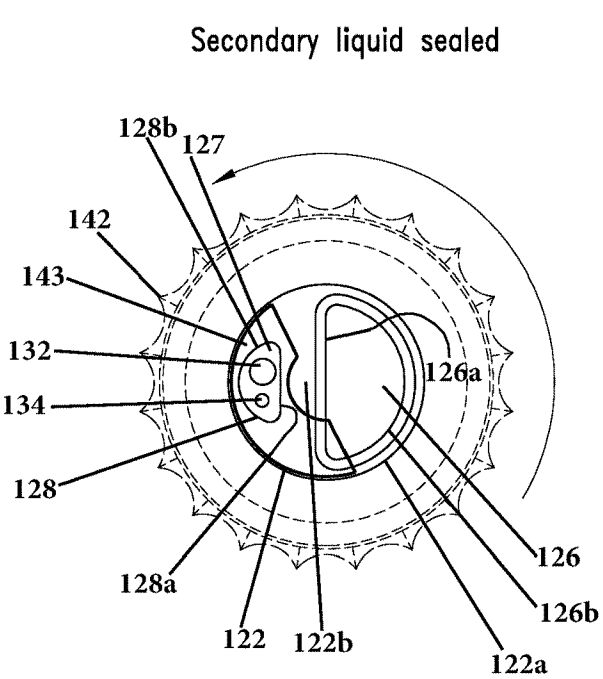
Figure 14:
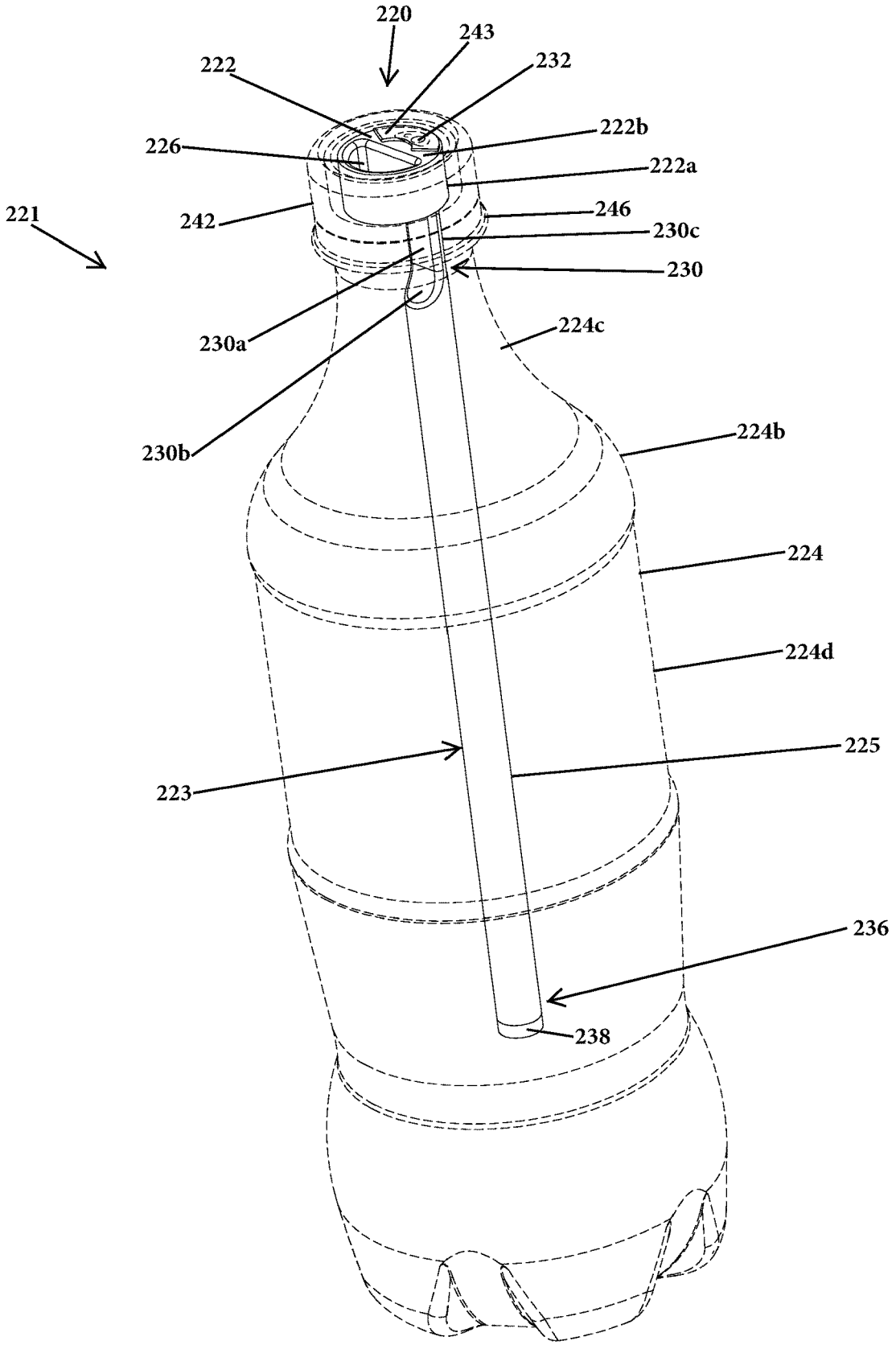
FIG. 14 is another liquid storage and dispensing system in accordance with the present invention in which the liquid storage and dispensing system includes a seal for use with a twist-off cap, and is shown secured to a plastic bottle.
Figure 15:
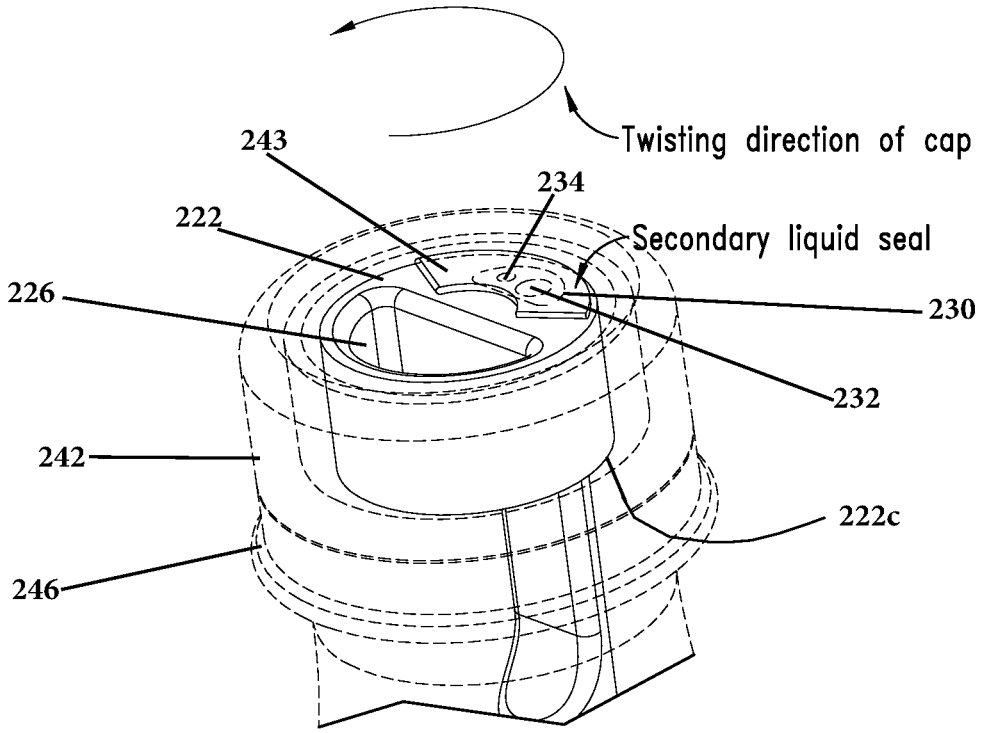
FIG. 15 is an enlarged view of a plastic twist-off bottle cap of the plastic bottle of FIG. 14.
Figure 16C:
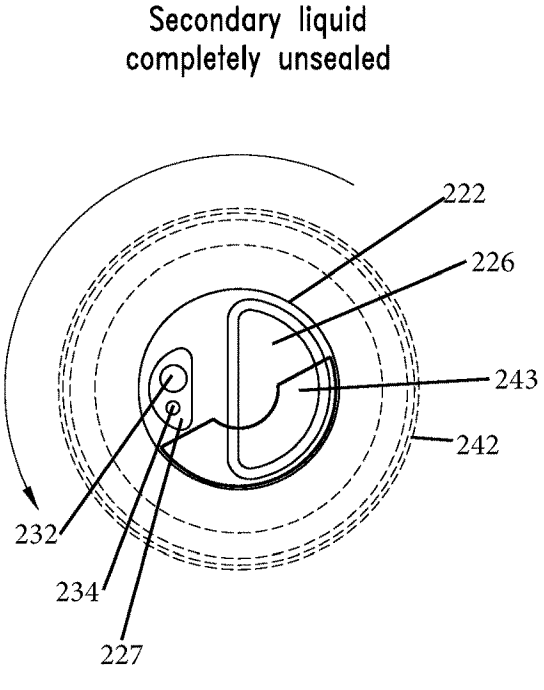
FIGS. 16A-16C show different positions of the seal as the plastic twist-off bottle cap of FIG. 14 is being rotated in an opening direction to unseal the reservoir portion of the liquid storage and dispensing system.
Figure 16B:
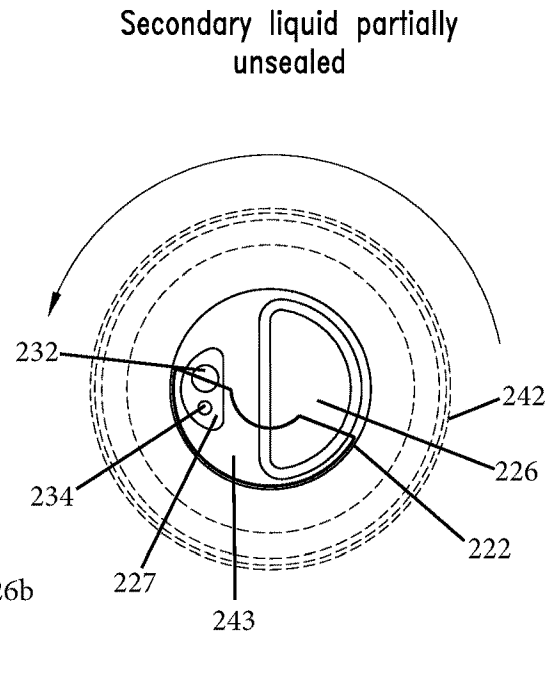
Figure 16A:
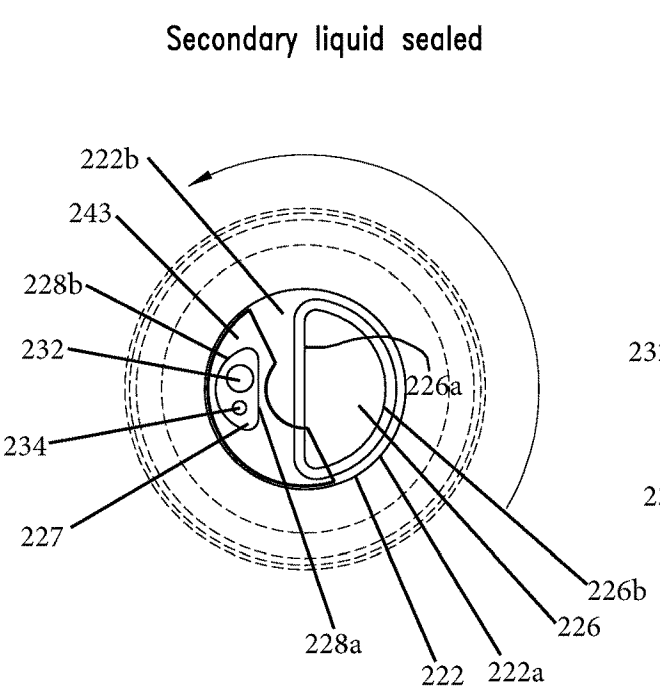

A consumer may twist or rotate cap 142 in an opening direction, for example in a counterclockwise direction as shown in FIGS. 12-13C, to remove or decouple rotatable seal 143 from head 122 and/or end 127 of funnel portion 130. During the rotation of cap 142 in the opening direction, inwardly-facing sides 143*c* of rotatable seal 143 may slide relative to one another as cap-facing side 143*a* of rotatable seal 143 remains adhered to lower side 142*a* of cap 142 to move relative to head-facing side 143*b* of rotatable seal 143. After sufficient rotation, the peelable adhesive B is decoupled from head 122 and/or end 127 of funnel portion 130 to uncover one or more of reservoir opening 132 and vent opening 134. At the same time, the non-peelable adhesive A remains adhered to lower side 142*a* of cap 142, such that the consumer may—after cap 142 has been fully unthreaded or desecured from bottle 124—lift cap 142 away from bottle 124 and dispense a liquid from either reservoir opening 132 or a container opening 126, in which reservoir opening 132 is fluidly connected to a reservoir 137 holding a first liquid or first beverage 148, and container opening 126 is fluidly connected to a bottle container portion 140 holding a second liquid or second beverage 150. It should be appreciated that a protective sheet, film, or layer could be placed over adhesive A and/or adhesive B before one or both sides of rotatable seal 143 are adhered to an object, such as the lower side of a cap and/or a head. Furthermore, a rotatable seal may take other forms, shapes, and/or sizes in either a folded or unfolded position that enable the rotatable seal to selectively cover and uncover a reservoir opening and/or a vent opening upon the rotation and/or removal of a cap.

In addition, in like manner to container assembly 21, container assembly 121 also includes a head outer surface 122*a*, a head bottom surface 122*c*, and a first half and a second half of head 122 separated by a center axis (not shown). A reservoir body 123 has a lower cylindrical portion 125 with a lower end 136 that can receive an end cap 138, and funnel portion 130 that protrudes into and/or through a funnel opening 128 defined by head 122. Container opening 126 has a flat portion 126*a* and a curved portion 126*b*, while funnel opening 128 similarly has a flat portion 128*a* and a curved portion 128*b*. Funnel portion 130 includes an upper end 130*a*, a curved transition section 130*b*, and an outboard section 130*c*. Bottle 124 also includes a shoulder 124*b* that connects a neck portion 124*c* to a cylindrical bottom base portion 124*d*, and further includes a wall 124*e*, a bottle orifice 144, and an orifice surface 144*a*.

Referring now to the illustrated embodiment of FIGS. 14-16C, another liquid storage and dispensing container assembly 221 is shown that is similar to liquid storage and dispensing container assembly 21, with similar features of container assembly 221 relative to container assembly 21 being designated with like reference numbers, but with "200" added to each reference number of container assembly 221. Due to the similarities of container assembly 221 relative to container assembly 21, not all of the components and features of container assembly 221 are discussed herein. Container assembly 221 includes a reservoir assembly or internal container 220 that is secured to a plastic bottle 224 having a plastic twist-off cap 242. Container assembly 221 works in a similar manner to the previously described container assembly 121, in which a rotatable seal 243 is initially sealed between cap 242 and a head 222 and/or an end 227 of a funnel portion 230, and may be subsequently twisted off or at least partially decoupled from head 222 and/or end 227 of funnel portion 230 by a consumer to allow the consumer to selectively dispense separate liquids contained within a bottle container portion 240 and/or a reservoir 237. In addition, in like manner to container assembly 121, container assembly 221 also includes a head outer surface 222*a*, a head top surface 222*b*, a head bottom surface 222*c*, and a first half and a second half of head 222 separated by a center axis (not shown). A reservoir body 223 has a lower cylindrical portion 225 with a lower end 236 that can receive an end cap 238, and a funnel portion 230 that protrudes into and/or through a funnel opening 228 defined by head 222. A container opening 226 has a flat portion 226*a* and a curved portion 226*b*, while funnel opening 228 similarly has a flat portion 228*a* and a curved portion 228*b*. Funnel portion 230 includes an upper end 230*a*, a curved transition section 230*b*, and an outboard section 230*c*. Bottle 224 also includes an upper portion 224*a* with connective features 246, a shoulder 224*b* that connects a neck portion 224*c* to a bottom base portion 224*d*, and further includes a wall (not labeled), a bottle orifice 244, and an orifice surface 244*a*. Reservoir 227 holds a first liquid or first beverage (not shown), while bottle container portion 240 holds a second liquid or second beverage (not shown).

Figure 17:
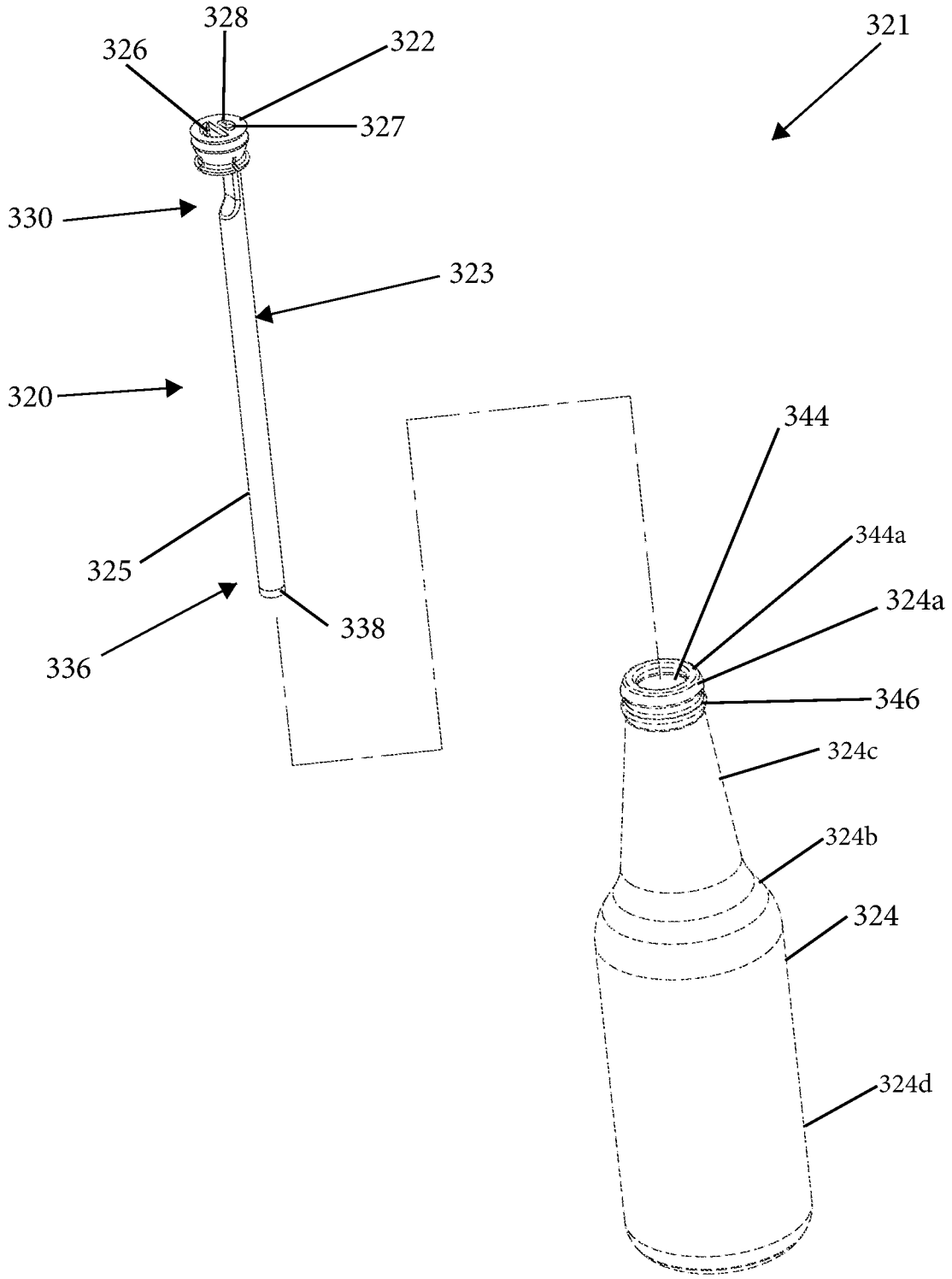
FIG. 17 is an exploded perspective view of another liquid storage and dispensing system in accordance with the present invention in which the liquid storage and dispensing system includes a head with engagement features to facilitate engagement between the head and a container.
Figure 18:
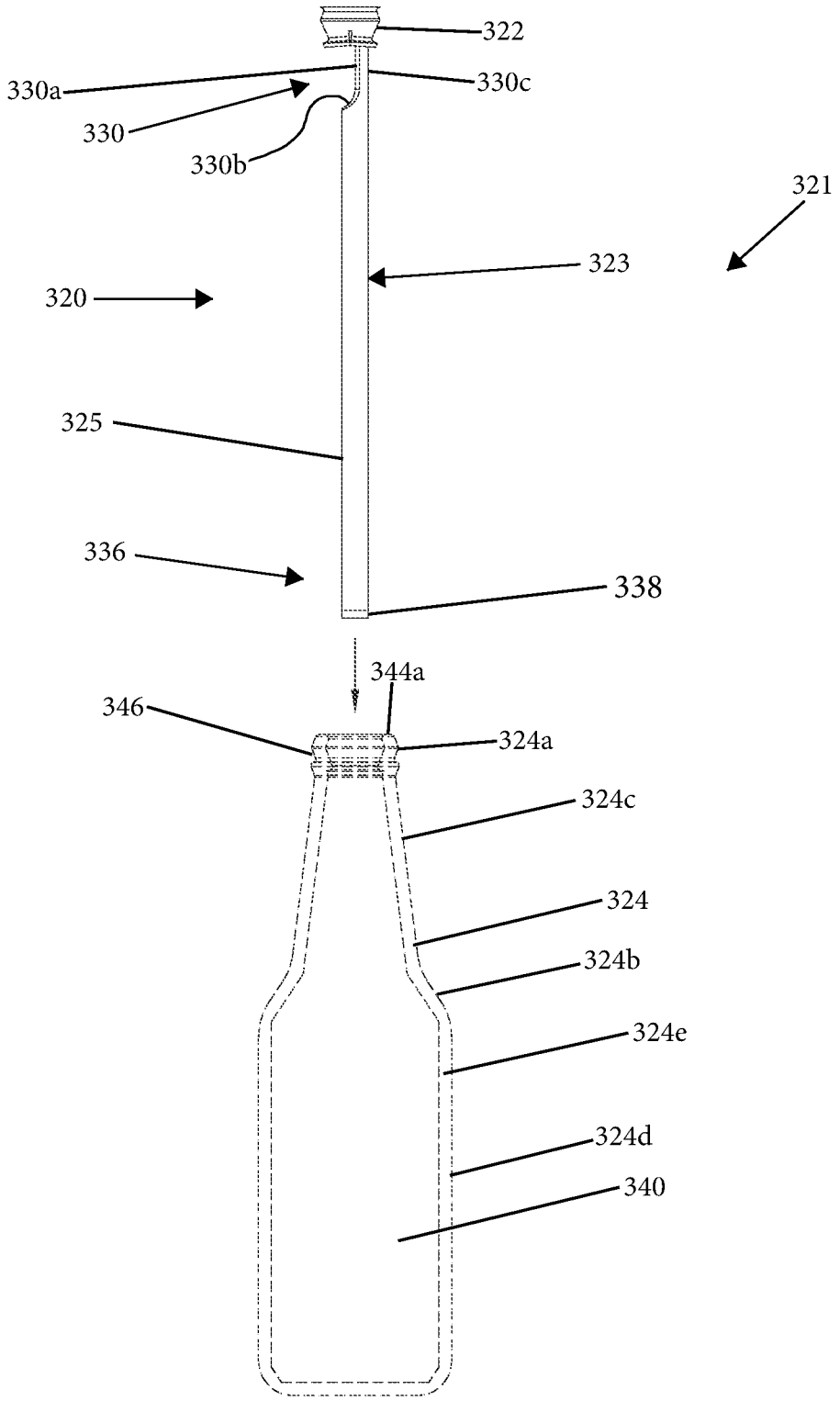
FIG. 18 is an exploded side elevation view of the liquid storage and dispensing system of FIG. 17.

Referring now to the illustrated embodiment of FIGS. 17-23, another liquid storage and dispensing container assembly 321 is shown that is similar to liquid storage and dispensing container assembly 21, with similar features of container assembly 321 relative to container assembly 21 being designated with like reference numbers, but with "300" added to each reference number of container assembly 321. Due to the similarities of container assembly 321 relative to container assembly 21, not all of the components and features of container assembly 321 are discussed herein. As shown, container assembly 321 has a reservoir assembly or internal container 320 disposed within a bottle 324, where bottle 324 defines a bottle container portion 340. (FIGS. 17 and 18). Bottle 324 includes a bottle orifice 344 with an orifice surface 344*a*, an upper portion 324*a*, a shoulder 324*b*, a cylindrical portion or neck portion 324*c*, a bottom base

Figure 19:
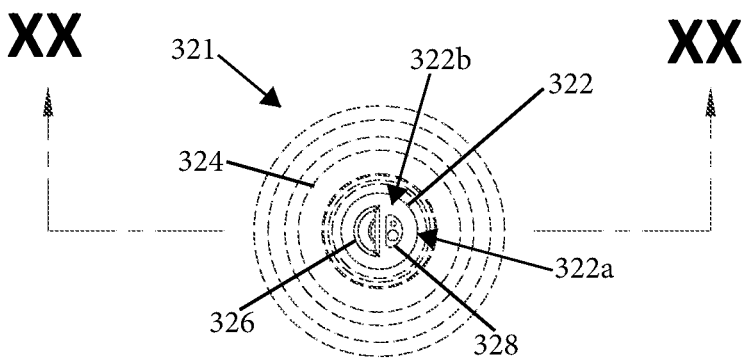
FIG. 19 is a top plan view of the liquid storage and dispensing system of FIG. 17.
Figure 20:
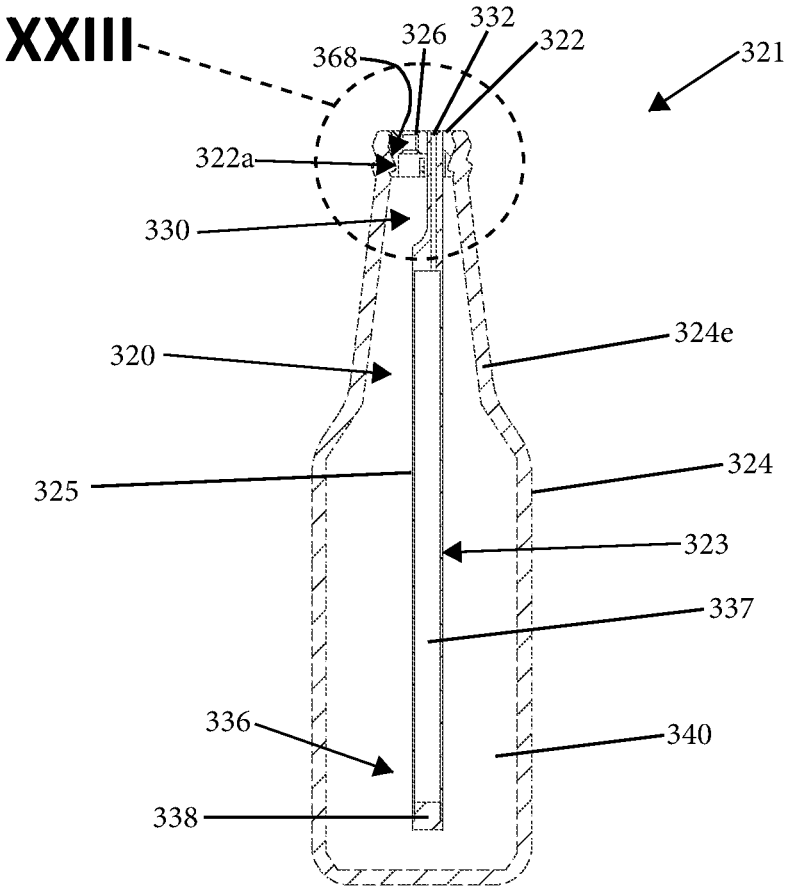
FIG. 20 is a cross sectional side elevation view of the liquid storage and dispensing system of FIG. 17 taken along the line XX of FIG. 19.
Figure 21:
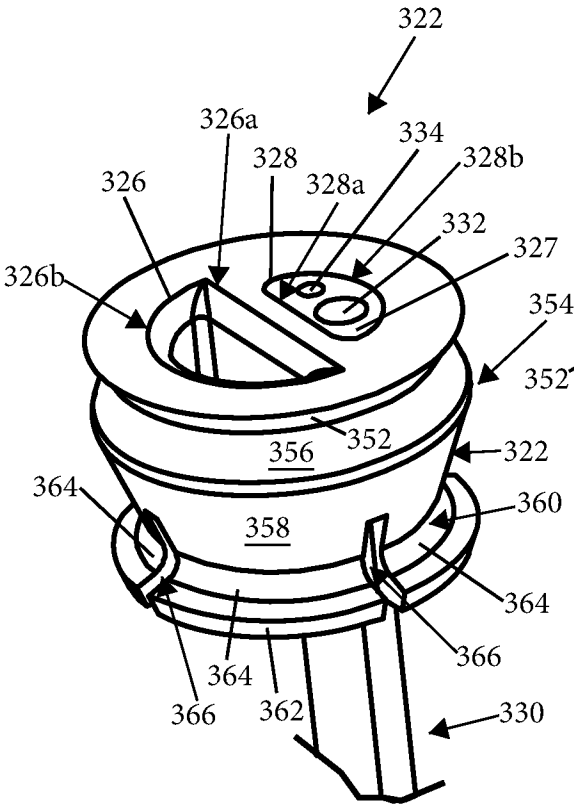
FIG. 21 is an enlarged view of the head of FIG. 17.

324*d*, a wall 324*e*, and connective features 346. Internal container 320 is coupled to a head 322 that defines a container opening 326 with a flat portion 326*a* and a curved portion 326*b*, and a funnel opening 328 with a flat portion 328*a* and a curved portion 328*b*. (FIGS. 18, 19, and 21). Internal container 320 includes a reservoir body 323 defining a reservoir 337 (FIG. 20), a lower cylindrical portion 325 with a lower end 336 and an end cap 338, and a funnel portion 330 with an upper end 330*a*, a curved section 330*b*, an outboard section 330*c*, and an end 327 that defines a reservoir opening 332 and a vent opening 334 (FIG. 21). Container portion 340 may hold or store a first liquid or beverage, while reservoir 337 may separately hold or store a second liquid or beverage. Although not shown, container assembly 321 may also include a cap, seal, or other components or features previously discussed herein in connection other embodiments of a liquid storage and dispensing container assembly.

Figure 23:
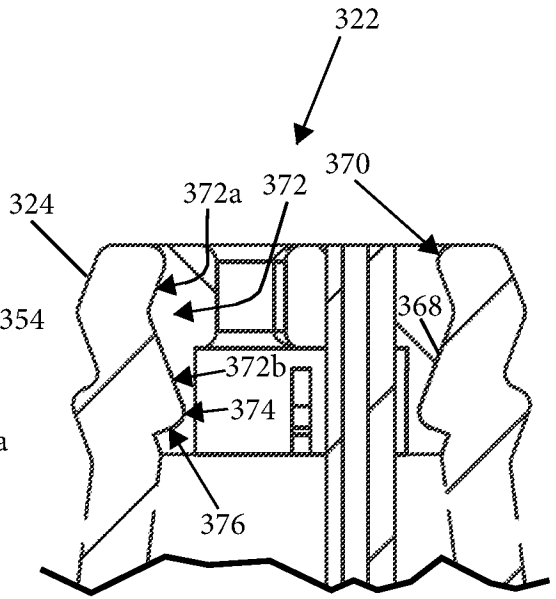
FIG. 23 is an enlarged view of the area designated "XXIII" in FIG. 20.
Figure 22:
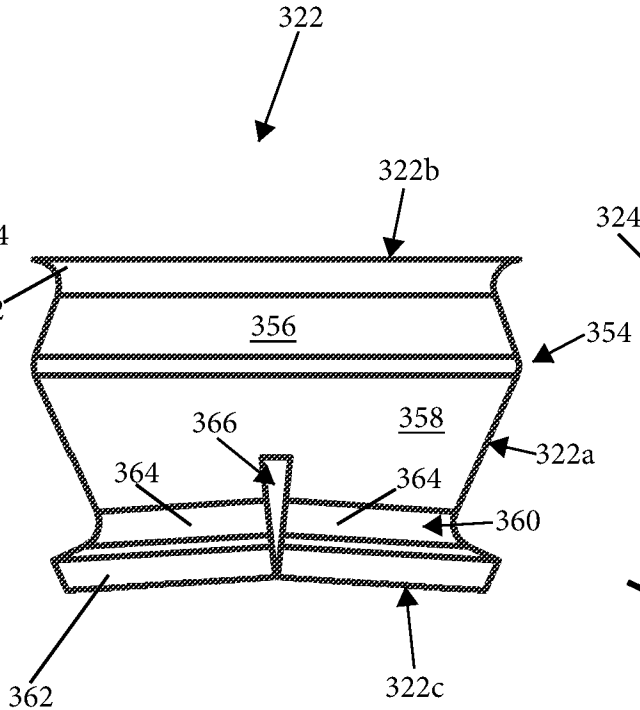
FIG. 22 is a side elevation view of the head of FIG. 21.

With reference to FIGS. 21-23, head 322 has an outer side surface 322*a* located between an upper round or circular-shaped top surface 322*b* and a lower bottom surface 322*c*. An upper lip or flange 352 flares and/or protrudes outwardly as it extends towards and/or to top surface 322*b*. A middle portion 354 of head 322 is bulged, widened, and/or bowed outwardly, and is located between an upper tapered portion 356 and a lower tapered portion 358. Upper tapered portion 356 is located between upper flange 352 and middle portion 354, and extends outwardly towards middle portion 354, while lower tapered portion 358 is located between middle portion 354 and a lower angled and/or arcuate portion 360, and extends inwardly toward arcuate portion 360. That is, in the illustrated embodiment, a circumference of upper tapered portion 356 is larger proximate and/or adjacent to middle portion 354 and smaller proximate and/or adjacent to upper flange 352, while a circumference of lower tapered portion 358 is larger proximate and/or adjacent to middle portion 354 and smaller proximate and/or adjacent to arcuate portion 360. Arcuate portion 360 flares and/or protrudes outwardly as it extends toward a lower lip or flange 362. Head 322 further includes a series of lower flexing sections 364 that are spaced-apart from one another by a series of vertically oriented spaces, relief slits, or slots 366 defined by head 322. Due to the features and geometry of head 322 described above, head 322 generally has an upper portion that is wedge-shaped and that terminates in a flange; a lower portion that is also wedge-shaped and that terminates in a flange, and that includes movable or flexible portions; and a bulging middle portion located between the upper and lower portions.

With particular reference to FIG. 23, bottle 324 includes geometry at an inboard side of wall 324*e* located at and/or proximate to orifice 344 for receiving and at least temporarily securing head 322 to bottle 324. In particular, bottle 324 includes a receiving portion 368 having a nonlinear and/or contoured mating or receiving surface 368 that is shaped complimentary to outer surface 322*a* of head 322 when flexing portions 364 of head 322 are in an un-flexed relaxed state (discussed below). Receiving surface 368 has an upper seating surface 370 configured to receive upper flange 352 of head 322. An outwardly v-shaped or bulged portion 372 includes an upper angled or tapered portion 372*a* that is connected to upper seating surface 370 and that extends outwardly in a direction away from upper seating surface 370, and a lower angled or tapered portion 372*b* that extends inwardly in a direction away from upper seating surface 370. An inwardly bulged portion 374 in the form of an inwardly extending ring, protrusion, or elbow is connected between lower tapered portion 372*b* and a lower seating surface 376. Lower seating surface 376 is configured to receive and/or engage and at least temporarily secure lower flange 362 of head 322. Accordingly, in the illustrated embodiment, the features and surfaces of receiving surface 368 are shaped to engage and/or mate with corresponding features and surfaces of outer surface 322*a* of head 322.

The above discussed features and geometry of receiving surface 368 of bottle 324 enable head 322 and internal container 320 to be coupled to bottle 324 at a desired position and configuration, for example, during the manufacturing and/or bottling process. In particular, internal container 320 may be coupled to bottle 324 via head 322, in which head 322 may be received and at least temporarily secured at and/or proximate to orifice 344 of bottle 324 via frictional engagement. When coupling internal container 320 and head 322 to bottle 324, internal container 320 may be initially inserted through orifice 344 and into bottle 324. During insertion, lower flange 362 of head 322 will come into physical contact with receiving surface 368 of bottle 324.

As head 322 is pushed or otherwise moved further into bottle 324, lower flange 362 will slide along at least a portion of receiving surface 368, including lower tapered portion 372*b* and bulged portion 374. Flexing sections 364 will be flexed inward as lower flange 362 slides downward along lower tapered portion 372*b* and bulged portion 374, thus allowing lower flange 362—and by extension head 322—to continue to move further into bottle 324. As shown in FIG. 22, slots 366 provide space and resiliency in head 322 for flexing sections 364 to deflect, deform, flex and/or bend inwardly towards one another in a stressed or flexed state. This is in contrast to when flexing sections 364 are in a relaxed or un-flexed state in which flexing sections 364 are not deflected, deformed, flexed, and/or bent. (FIG. 21). After lower flange 362 slides past bulged portion 374, flexing sections 364 flex back outward towards the relaxed state, in which lower flange 362 also flexes and/or moves outward such that lower flange 362 is received by and/or becomes seated against lower seating surface 376, such as shown in FIG. 23.

The engagement between lower seating surface 376 and lower flange 362 at least partially restrains or prevents head 322 from inadvertently becoming dislodged or otherwise decoupled from bottle 324, such as while a user is tipping bottle 324 to take a drink of the first and/or second beverage. Additionally, once lower flange 362 is engaged with lower seating surface 376, upper flange 352 will also be received by and/or become engaged or seated against upper seating surface 370 such that head 322 is at least partially restrained or prevented from being pushed further into bottle 324. Once engaged with upper seating surface 370, upper flange 352 will be in a position so as to not interfere with or impede with the functionality of bottle 324, such as for example the ability of a cap to be coupled to bottle 324 and sealed against a surface of bottle 324, such as orifice surface 344*a*. Furthermore, the remainder of side surface 322*a* of head 322 also becomes seated against or otherwise engaged with receiving surface 368 to form a fluid tight connection between side surface 322*a* and receiving surface 368. That is, once head 322 is secured at or proximate to neck portion 324*c* of bottle 324, the angles of side surface 322*a* and corresponding portions of receiving surface 368 that are engaged or physically in contact with one another will be substantially the same. Through the above discussed process, head 322 and internal container 320 become coupled to bottle 324 at a desired position, for example, a position in which internal container 320 is straight and/or aligned with a longitudinal axis of bottle 324 such as that shown in FIG. 20. The coupling of these components to one another in this fashion may provide for a more cost effective, secure, and consistent way of assembling and manufacturing a liquid storage and dispensing container assembly within the scope of the present invention.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A liquid storage and dispensing assembly comprising:
- an outer container defining an internal volume configured to hold a first liquid, and comprising an orifice;
- an internal container configured to be disposed within said internal volume, and comprising a reservoir body defining a reservoir configured to hold a second liquid separate from the first liquid; and
- a head coupled at said orifice and comprising a container opening and a reservoir opening, said container opening in fluid communication with said internal volume to enable the first liquid to be dispensed from said container opening, and said reservoir opening in fluid communication with said reservoir to enable the second liquid to be dispensed from said reservoir opening;
- wherein said head comprises a first half and a second half that are delineated by a center axis, wherein said container opening is defined within said first half, and wherein said reservoir opening is defined within said second half.

2. The liquid storage and dispensing assembly of claim 1, wherein the first liquid is dispensable from said internal volume via said container opening while the second liquid is not dispensed from said reservoir;
- wherein the second liquid is dispensable from said reservoir via said reservoir opening while the first liquid is not dispensed from said internal volume; and
- wherein the first and second liquids are simultaneously dispensable from said reservoir and said internal volume via respective said container opening and said reservoir opening.

3. The liquid storage and dispensing assembly of claim 1, wherein said head further comprises a vent opening fluidly coupled to said reservoir.

4. The liquid storage and dispensing assembly of claim 1, wherein said reservoir body comprises a lower portion and a funnel portion, wherein said funnel portion has a smaller cross-sectional area than said lower portion and comprises an upper end at which said reservoir opening is disposed, and wherein said head further comprises a reservoir passageway through which said funnel portion is inserted with said upper end of said funnel portion exposed at an upper surface of said head.

5. The liquid storage and dispensing assembly of claim 1, further comprising a cap coupled at said orifice, wherein said cap is selectively removable from said orifice and encloses said internal container within said outer container when said cap is coupled at said orifice.

6. The liquid storage and dispensing assembly of claim 5, further comprising a seal coupled to said head and covering said reservoir opening, said seal removable from said head upon said cap being removed from said orifice.

7. The liquid storage and dispensing assembly of claim 6, wherein said seal further comprises a non-peelable adhesive disposed on a cap-facing side of said seal, and a peelable adhesive disposed on a head-facing side of said seal such that said seal remains coupled to said cap when said cap is removed from said orifice.

8. The liquid storage and dispensing assembly of claim 7, wherein said seal comprises an annular shape that is foldable into a C-shaped seal, said C-shaped seal covering said reservoir opening.

9. The liquid storage and dispensing assembly of claim 8, wherein said cap is rotatable in an opening direction to be removed from said orifice, and wherein inwardly facing sides of said C-shaped seal slide relative to one another when said cap is rotated in the opening direction to be removed from said orifice.

10. The liquid storage and dispensing assembly of claim 1, wherein said head comprises a circular outer perimeter surface that mates with an inner diameter of said orifice.

11. The liquid storage and dispensing assembly of claim 10, wherein said container opening defines a closed loop passageway.

12. An internal container assembly for retaining a liquid and nesting within an outer container comprising a wall defining an orifice and an internal volume retaining another liquid, said internal container assembly comprising:
- a reservoir body defining a reservoir; and
- a head coupled to said reservoir body and comprising a container opening and a reservoir opening, said head configured to be engaged with the wall of the outer container at the orifice of the outer container;
- wherein when said head is engaged with the wall of the outer container at the orifice of the outer container, said internal container assembly is nested within the outer container, said container opening is fluidly coupled to an internal volume of the outer container to enable a first liquid contained within the internal volume to be dispensed from said container opening, and said reservoir opening is fluidly coupled to said reservoir to enable a second liquid contained within said reservoir to be dispensed from said reservoir opening.

13. The internal container assembly of claim 12, further comprising a removable seal coupled to said head and covering said reservoir opening.

14. The internal container assembly of claim 12, wherein said head further comprises a vent opening fluidly coupled to said reservoir.

15. The internal container assembly of claim 12, wherein said head comprises a circular outer perimeter surface configured to mate with an inner diameter of the orifice of the outer container.

16. The internal container assembly of claim 12, wherein said reservoir body comprises an elongate cylindrical body and an end cap removably coupled to a lower portion of said reservoir body.

17. The internal container assembly of claim 16, wherein said reservoir body further comprises a funnel portion, wherein said funnel portion has a smaller cross-sectional area than said lower portion and comprises an upper end at which said reservoir opening is disposed, and wherein said head further comprises a reservoir passageway through which said funnel portion is inserted with said upper end of said funnel portion exposed at an upper surface of said head.

18. A liquid storage and dispensing assembly comprising:
- an outer container defining an internal volume for holding a first liquid, and comprising an orifice;

an internal container assembly nested within said internal volume, and comprising a reservoir body defining a reservoir for holding a second liquid separate from the first liquid; and a head mated at an inner diameter of said orifice to form a fluid-tight connection between said head and said inner diameter of said orifice, and comprising a first half and a second half delineated by a center axis, a container opening disposed at said first half and defining a closed loop passageway fluidly coupled to said internal volume, and a reservoir opening disposed at said second half and fluidly coupled to said reservoir;

wherein the first and second liquids remain separate from one another until said outer container is oriented to selectively: (i) dispense the first liquid from said container opening independent of the second liquid being dispensed from said reservoir opening; (ii) dispense the second liquid from said reservoir opening independent of the first liquid being dispensed from said container opening; or (iii) dispense both the first and second liquids simultaneously from respective said container opening and said reservoir opening.

19. The liquid storage and dispensing assembly of claim 18, wherein said reservoir body comprises a lower portion, a funnel portion, and a curved section connecting said lower portion to said funnel portion, wherein said funnel portion has a smaller cross-sectional area than said lower portion and comprises an upper end at which said reservoir opening is disposed.

* * * * *